United States Patent [19]

NakaMats

[11] Patent Number: 4,933,822

[45] Date of Patent: Jun. 12, 1990

[54] MOVABLE REFLECTING RAY TRANSMITTER

[76] Inventor: Yoshiro NakaMats, 1-10-1105, Minami Aoyama 5-chome, Minato-ku, Tokyo, Japan

[21] Appl. No.: 253,449

[22] Filed: Oct. 4, 1988

Related U.S. Application Data

[63] Continuation-in-part of Ser. No. 44,930, May 1, 1987, abandoned.

[30] Foreign Application Priority Data

Nov. 15, 1986 [JP] Japan ..... 270874

[51] Int. Cl.[5] ..... F21V 7/00

[52] U.S. Cl. ..... 362/282; 362/290; 362/294; 362/296; 362/328; 362/347; 362/399; 362/410; 362/414; 362/431; 40/366

[58] Field of Search ..... 362/135, 138, 139, 142, 362/144, 277, 282, 290, 291, 292, 294, 296, 322, 327, 328, 341, 345, 346, 347, 373, 399, 400, 410, 431, 432, 413, 414; 248/121, 145.6; 40/363, 366, 513

[56] References Cited

U.S. PATENT DOCUMENTS

| | | | |
|---|---|---|---|
| 1,301,162 | 4/1919 | Otte | 362/291 |
| 1,429,763 | 9/1922 | O'Mara | 248/145.6 |
| 2,026,010 | 12/1935 | Ritz-Woller | 362/142 |
| 2,636,112 | 4/1953 | Dvorsky | 362/413 |
| 3,275,823 | 9/1966 | Zimmerman et al. | 362/294 |
| 3,446,955 | 5/1969 | Bailey et al. | 362/290 |
| 4,337,506 | 6/1982 | Terada | 362/410 |
| 4,388,678 | 6/1983 | Turner | 362/294 |
| 4,392,192 | 7/1983 | Steadman | 362/431 |

FOREIGN PATENT DOCUMENTS

| | | | |
|---|---|---|---|
| 203098 | 10/1948 | Austria | 362/294 |
| 326644 | 9/1920 | Fed. Rep. of Germany | 362/341 |
| 5001 | of 1897 | United Kingdom | 362/282 |

*Primary Examiner*—Noah P. Kamen
*Attorney, Agent, or Firm*—Jordan and Hamburg

[57] ABSTRACT

A light transmitting device includes an open ended cylindrical body with a light source mounted in the end thereof opposite the open end. A mirror is spaced from the open end, and mounted for rotation about an axis substantially perpendicular to the axis of the cylindrical body, that intersects the axis of the cylindrical body. The cylindrical body may include or be mounted on a pole or other stand. At least one vent may be provided in the cylindrical body open to the gap between the body and the light source. The mirror may be mounted to also be rotatable about the axis of the cylindrical body. The components of the device are easily assembled and disassembled.

8 Claims, 26 Drawing Sheets

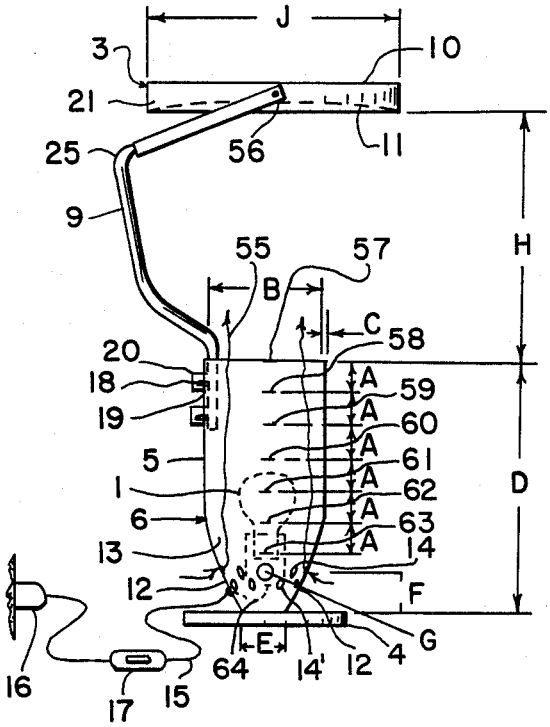
FIG. 17
FIG. 18
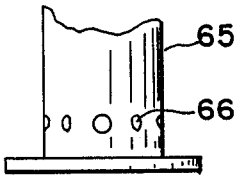
FIG. 19
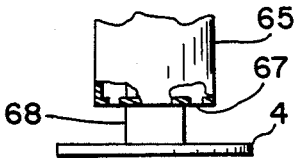

MOVABLE REFLECTING RAY TRANSMITTER

This application is a continuation-in-part, of application Ser. No. 044,930, filed May 1, 1987, now abandoned.

This invention relates to a movable reflecting ray transmitter, and is more particularly directed to an apparatus comprising a source of radiation and a reflecting device for directing the radiation for various purposes. The radiation is preferably in the form of either visible light and/or infrared radiation.

The purpose of the invention is as follows:

1. To make it possible to read books while lying down.
2. To provide an easily removable light spot without a moving lamp.
3. To provide an easy change in a spot area without a moving lamp.
4. To provide an easy change in light intensity without a changing switch.
5. To provide a device usable as a make-up mirror.
6. To provide a device usable as a shaving mirror.
7. To provide a non-glare light.
8. To provide a lighting device which does not reflect light from a reading surface.
9. To provide a lighting device which does not warm a person's head while reading by having the heat escape upwardly.
10. To provide a lighting device which is good for brain activity because the brain is not heated up.
11. To provide a lighting device requiring a smaller electric power because of superior lighting efficiency.
12. To provide longer life for a bulb because of cooling by a chimney effect.
13. To provide a small, compact, and collapsible to ½ lighting device for storage and transportation convenience.
14. To provide a lighting device which can be placed anywhere without a clamp and which is usable as a photo copy light.
15. To provide a lighting device having a low center of gravity which makes it stable so that it does not fall down.
16. To provide a lighting device which does not result in a hanging head.
17. To provide a lighting device which is attachable to a wall.
18. To provide a lighting device having no moving parts and which is trouble-free.
19. To provide a mirror for health purposes.
20. To provide a device which changes room atmosphere such as by providing shade on the ceiling, and to make the ceiling look higher and the room look wider by directing the light to the ceiling.
21. To provide a lighting device usable with various adapters such as for infrared heaters, photo negative film viewer, etc.

Conventional lighting devices are comprised of a light source, such as a light bulb, and an arrangement for directing the light to a desired position. Conventional arrangements of this type are generally single purpose devices, for example, being capable of lighting a surface in only one mode. In addition, various lighting devices have disadvantages such as the direction of heat generated from the lamp to undesirable locations, as well as the inability to perform more than one or a minimum number of functions.

The present invention is therefore directed to the provision of a movable reflecting ray transmitter that overcomes the above disadvantages of known devices. Specifically, the transmitter of the invention, which may be employed, for example, as a light source or a heat source, is adjustable to many different modes of operation, and is in the form of a compact simply and easily manufactured device.

Briefly stated, in accordance with one embodiment of the invention, a reflecting ray transmitting device is comprised of a cylindrical body having an open type. The bottom of the cylindrical body tapers inwardly, and a ray transmitter such as a lamp is mounted within the bottom of the cylindrical body. At least one vent or aperture is provided in the sloping bottom side wall of the cylindrical body, to permit the flow of air into the gap between the cylindrical body and the lamp. The cylindrical body may be mounted vertically on a stand. The vertical alignment of the cylindrical body thereby creates a chimney effect, with hot air rising past the lamp through the open top of the cylindrical body.

A mirror is mounted above the open top of the cylindrical body, on a pivot axis substantially in line with the axis of the cylindrical body. One side of the mirror is a plane surface and the other side thereof is a concave surface. The mirror is freely pivotable about its axis, to enable the reflection of light from the concave surface or the plane surface in any desired direction. Thus, the light may be directed upwardly, horizontally or downwardly from either the plane or concave surface, without causing the heat of the rising hot air to follow the path of the light radiation.

In modifications of the invention, a photographic image may be placed on top of the cylindrical body, for viewing by way of the mirror. Similarly, a small television set may be placed on top of the body for viewing either by way of reflection from the plane mirror or the concave mirror. The arrangement is readily disassembled for storing and/or shipping, to minimize its cost.

Further vents may be provided at the base of the cylindrical body, for increasing the chimney effect, and fins or louvers may be inserted in the top of the cylindrical body to avoid direct viewing of the lamp in the cylindrical body. The cylindrical body is adapted to be mounted on a wall, for a further application of the structure.

The ray source within the cylindrical body may be an infrared lamp, to enable use of the device as a heating device, or an ultraviolet source to permit various further uses of the arrangement.

In still further arrangements in accordance with the invention the cylindrical body may be mounted on top of a pole, or the cylindrical body may itself be in the form of a pole. In this latter case, due to the extended length of the cylindrical body, it is not necessary to taper the bottom of the cylindrical body. The pole may be partially or wholly transparent and/or translucent, and may be telescoping, collapsible, etc., or comprised of a number of easily assembled pipe sections to enable varying its length.

In still further embodiments of the invention, the mirror may be mounted on top of the cylindrical body and/or pole to be rotatable about a vertical axis, to thereby still further increase the applications of the device.

The arm holding the mirror above the cylindrical body may serve as a handle for the device, or, alternatively, a separate handle may be affixed to the cylindrical body, for example, by the same screws that hold the arm thereto. Alternatively, the arm itself may be held in the handle, rather than directly to the cylindrical body.

In a still further embodiment of the invention, a shade hood may be mounted over the mirror.

BRIEF DESCRIPTION OF THE DRAWINGS

In order that the invention may be more clearly understood, it will now be disclosed in greater detail with reference to the accompanying drawings, wherein:

FIG. 17 illustrates various positions on the lamp of the invention for use in conjunction with the thermal measurements of Table 1 in this disclosure;

FIG. 18 illustrates the base of a cylindrical body without tapering, with holes directed laterally therein;

FIG. 19 illustrates a similar structure with holes in the bottom thereof, to illustrate some disadvantages of these arrangements as compared with the lamp structure of FIG. 1;

DETAILED DISCLOSURE OF THE INVENTION

Figure 1:
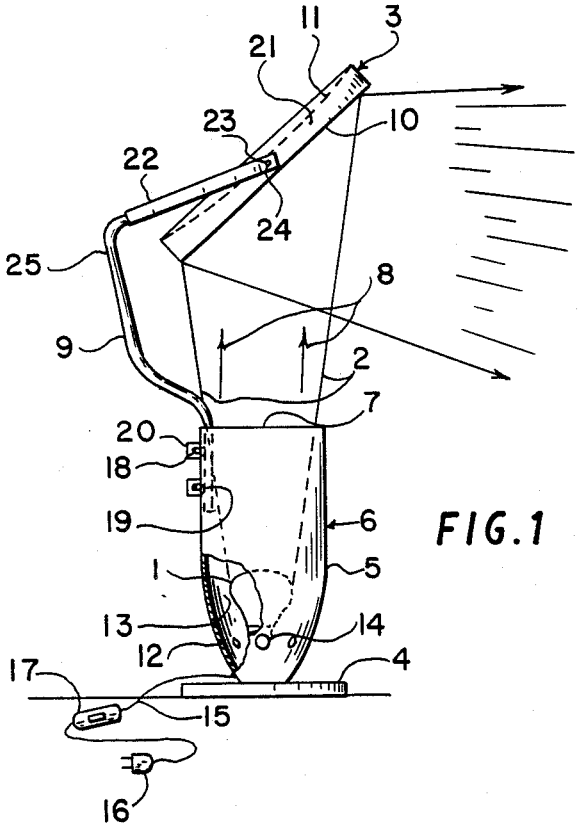
FIG. 1 is a simplified partially cross sectional view of a lamp in accordance with one embodiment of the invention.

FIG. 1 illustrates an embodiment of this invention which comprises a radiated light generating device such as a light source lamp 1 and a reflector 3 mounted to freely change the direction of light 2 light from the reflected light source lamp 1 and to collect and spread the light 2.

The light source lamp 1 is accommodated within an upwardly open cylindrical body 5 and is attached onto a stand 4 in an upright position. The members 1, 3, 4 and 5 form the light source device 6. Heat from the light source lamp 1 produces a hot air stream rising from the opening mouth 7 of the cylindrical body 5. Reflector 3 is held by an arm 9 fixed onto the inner wall of the cylindrical body 5 outside of the hot air stream 8. The reflector 3 is a plane mirror 10 on one side and a concave mirror 11 on the opposite side and is supported by the arm 9 for free rotation. As a result, it is alternatively possible to collect light 2 by reflecting light 2 from the light source lamp 1 on the concave mirror 11 or to spread light 2 by reflecting light 2 on the plane mirror 10, e.g., it is possible to freely change the spread of light 2.

The lower portion of the cylindrical body 5 enclosing the light source 6 tapers inwardly in the downward direction to define a slope 12. A vent 14 is provided in the slope 12 open to gap 13 between the inside of the cylindrical body 5 and the lamp 1.

A plug 15 and a switch 17 are attached to the supply source cord 15 which enters the lower portion of the cylindrical body 5 to connect to the light source lamp 1.

Two screws 18 are mounted on the arm 9 and extend from the inside of the cylindrical body 5 through holes 19 in cylindrical body 5, the screws 18 extending outside of cylindrical body 5 and being tightened by nuts in the form of knobs 20 to hold the arm 9 onto the cylindrical body 5.

Figure 14:
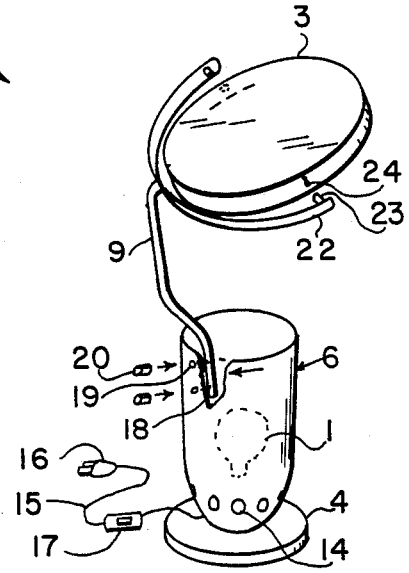
FIG. 14 is a perspective partially exploded view of the lamp of FIG. 13.

The upper portion of arm 9 branches into two directions as seen for example in FIG. 14, to form a mirror supporting frame 22 for holding the frame 21 of mirror 3 at both sides, and a separate pivot 23 is provided adjacent each end of the two branches. The mirror 3 is set between the pivots 23, expanding the spacing of pivots 23, and pivots 23 are inserted into diametrically opposite holes 24 of mirror frame 21 to enable the free rotation of mirror 3 about pivots 23 and to enable stopping of the mirror 3 at any desired position. Arm 9 holds the mirror in a position so that the center of the mirror 3 is substantially aligned with the light axis line of lamp 1, and the arm 9 overhangs the outside of the cylindrical body 7 so that it is not heated by heat rising up from the lamp 1 through the cylindrical body 7. The overhung portion 25 can be used as a handle.

Figure 72:
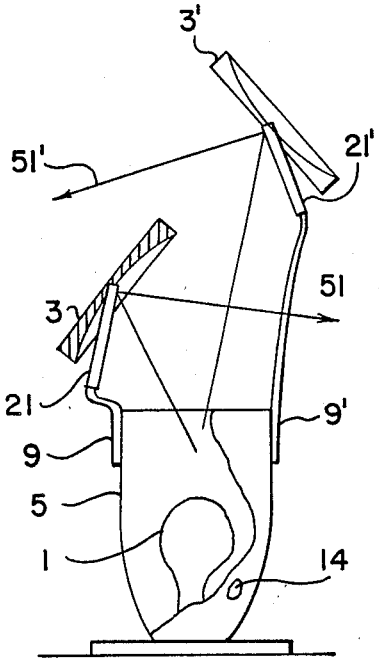
FIG. 72 is a partially cross sectional view of another embodiment of the invention.
Figure 73:
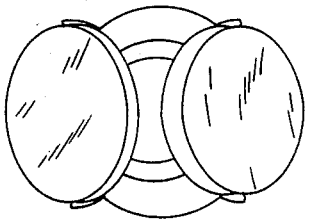
FIG. 73 is a plane view of FIG. 72.

FIGS. 72,73 show the embodiment of the invention wherein two arms 9 and 9' are attached to cylindrical body 5 and two mirrors 3 and 3' are supported by two frames 21 and 21' to freely move at the top end of arms 9 and 9' to send lights 51 and 51' reflected by each mirror to two directions.

Figure 2:
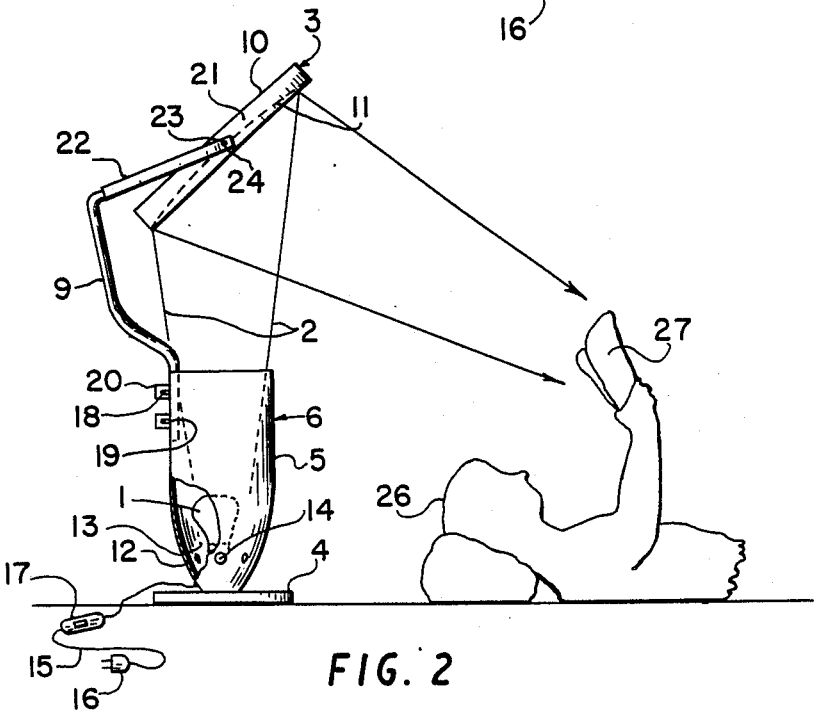
FIG. 2 is an illustration of the use of the lamp of FIG. 1 in the reading of a book.

FIG. 2 illustrates an example of the use of the lamp of FIG. 1 wherein light 2 from lamp 1 can easily be transmitted in various directions by turning the mirror 3. For example, when a man 26, lying on his back, looks at a book 27, light 2 reflected by the concave mirror 11 is transmitted onto the open surface of book 27, and it is possible to freely light even such a low inclined surface.

Figure 3:
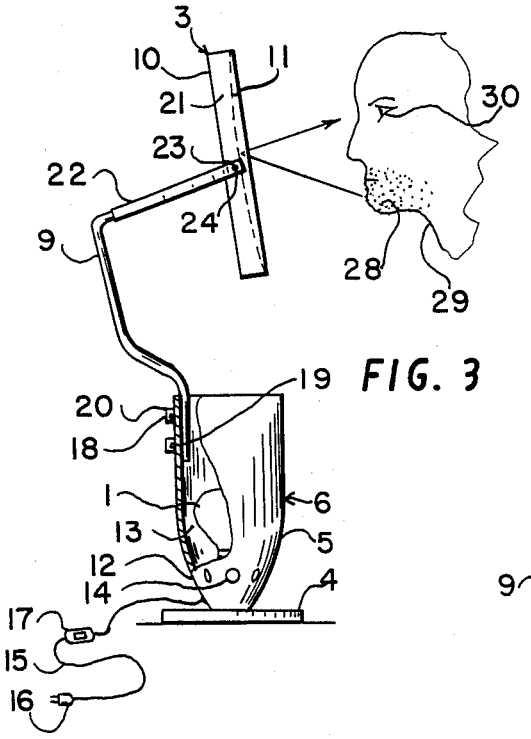
FIG. 3 is a simplified illustration of the use of the lamp of FIG. 1 in shaving.

FIG. 3 illustrates an example of use of the invention of FIG. 1 for shaving, wherein a man 29 with a beard 28 can take care of his beard. The man can view an enlarged and reflected beard 28 with his eye 30 by turning the mirror 3 so that he faces the concave mirror 11, adjusting its angle to enable viewing of the beard.

Figure 4:
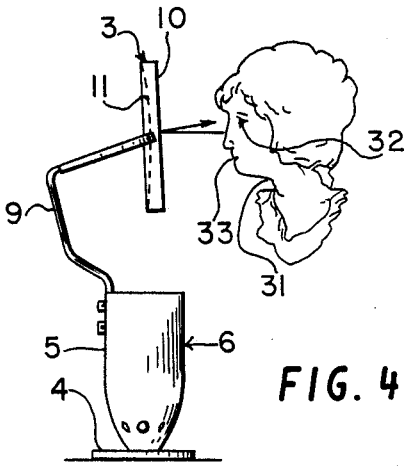
FIG. 4 is a simplified illustration of the use of the lamp of FIG. 1 for viewing the face.

FIG. 4 illustrates the use of the invention wherein a woman 31 makes up her face 33 in the front of the plane mirror 10 by turning the mirror 3 and adjusting its angle, so that her eye 32 can view her whole face 33 reflected on the plane mirror 10.

Figure 5:
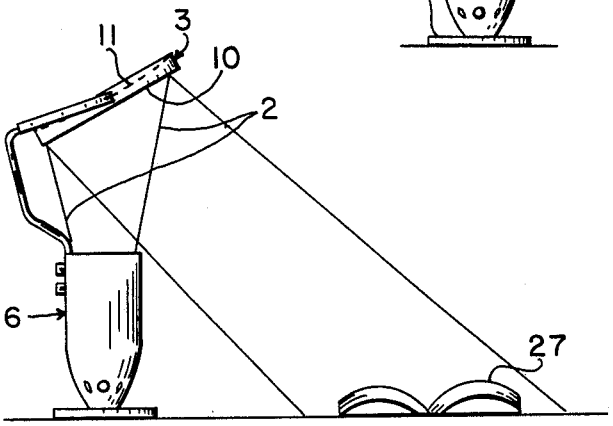
FIG. 5 is a simplified illustration of the use of the lamp in illuminating a book.
Figure 6:
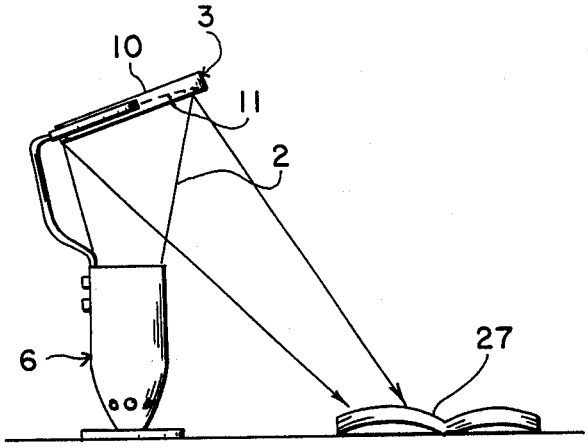
FIG. 6 is a simplified illustration of the lamp of FIG. 1 illustrating the illumination of only part of the book, as compared with the arrangment of FIG. 5.

FIG. 5 illustrates the use of the lamp of the invention to fully light book 27, etc. on a desk by inclining the plane mirror 10 of mirror 3 and reflecting and spreading light 2 from light source device on the mirror 10. It is alternatively possible to light a part of the book 27, etc more brightly by turning the mirror 3 and reflecting the light 2 from the concave mirror 11 as shown in FIG. 6

Figure 7:
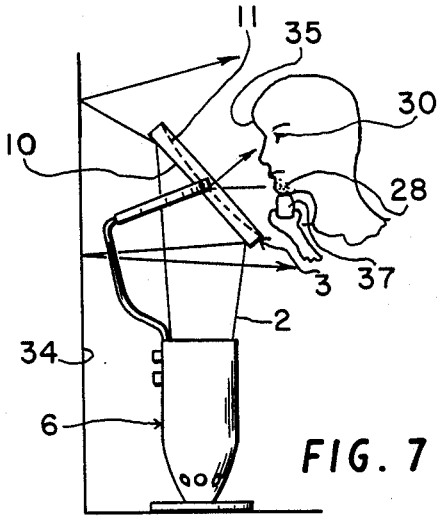
FIG. 7 is a further illustration of the use of the lamp of FIG. 1 in shaving.

FIG. 7 illustrates the use of the lamp of the invention wherein the lamp is placed on a wall 34 and light 2 from light source device is reflected on the wall surface 34 from the plane mirror 10 of mirror 3. The reflected light shines indirectly on the human face 35 so that the eye 30 can view the beard 28 of face 35 on concave mirror 11 on the other side of the same mirror 3, to enable shaving with the razor 37. The apparatus of the invention can thus simultaneously serve both lighting and reflecting functions.

Figure 8:
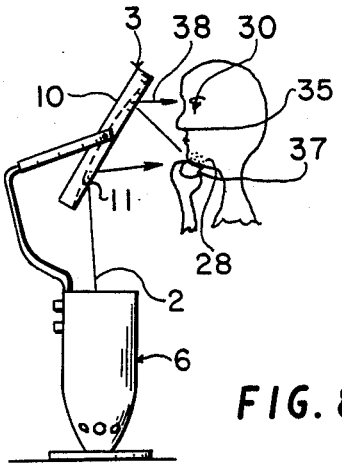
FIG. 8 is a further illustration of the lamp of FIG. 1 in use in simplifying the making up of one's face.

FIG. 8 shows the use of the invention wherein light 2 from the light source is collected on the beard 28 of a man's face 35 by the concave mirror 11 of mirror 3 to brightly light the beard 28, and the man's eye 30 can view the lighted beard 28 on the same mirror 11 to enable shaving with the razor 37, without glare, since the light 2 shining on the beard 28 is not directed toward the eye 30.

As described above, this invention makes it possible for a single unit to have multiple uses such as in shaving, making-up and lighting a book, etc. and moreover it is possible to freely adJust the lighting position, area and brightness.

Figure 9:
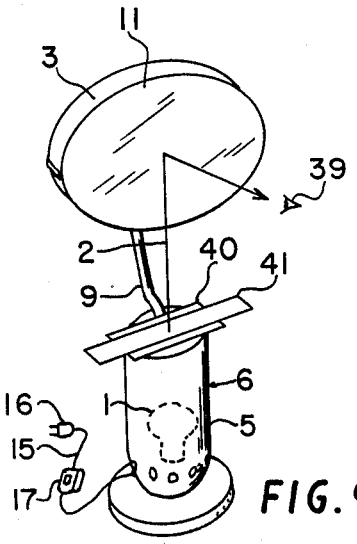
FIG. 9 is a perspective view of the use of the lamp of FIG. 1 in projecting an image from a transparency.

FIG. 9 shows the use of the device of the invention of FIG. 1 as an image lighting apparatus and wherein 40 is an opaque milky white glass plate. Photographic film 41 is placed on the plate, and the plate is placed across the upper portion of the cylindrical body 5.

Light 2 from lamp 1 passes through the film 41 and reflects on mirror 3 and the image of the film 41 reflected on the mirror or enlarged on concave mirror 11 can be seen in detail by the eye 39 When using a concave mirror, it is possible to see an enlarged image. If the glass plate is removed from the cylindrical body 5, light from lamp 1 reflects directly on the mirror 3, and can be used again as lighting apparatus.

Figure 10:
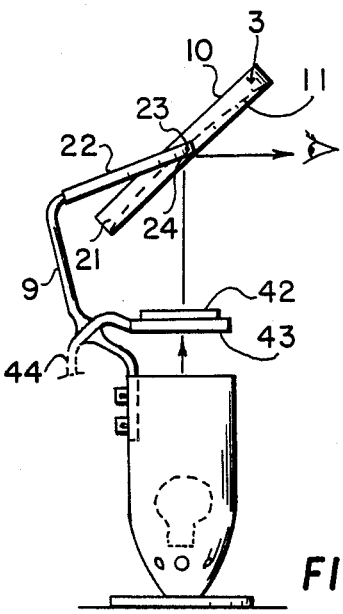
FIG. 10 illustrates the use of the lamp in viewing a liquid crystal television set.

FIG. 10 shows the use of the lamp of this invention wherein a liquid crystal television set 42 is viewed by attaching it onto mounting device 43 attached to the frame 9. It is possible to reflect the television image on mirror 3 and view in detail the image enlarged on the concave mirror 11. Mounting device 43 can be disassembled by pivoting the center of the arm holding device 43 to the position 44 shown in part in dashed lines.

Figure 11:
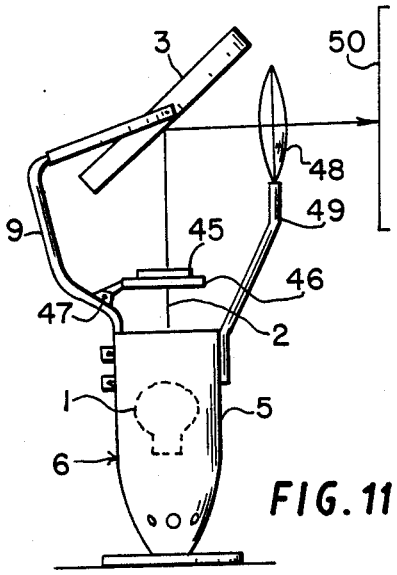
FIG. 11 illustrates the embodiment of the invention for mounting a photo slide.
Figure 12:
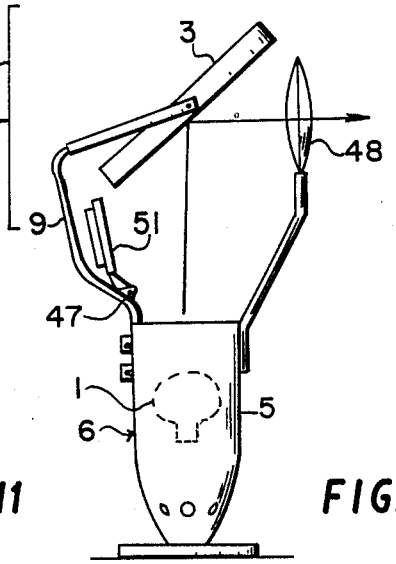
FIG. 12 illustrates the setting of the device of FIG. 11 to employ it solely as a lighting device.

FIG. 11 illustrates the use of the lamp of the invention wherein a device 46 for mounting a photo slide 45 is mounted on the arm 9 to rotate on axis 47 Light 2 from lamp 1 passes through the photo slide 45 and reflects on the mirror 3. The image of the photo slide 45 is projected on a screen 50 by lens 48. FIG. 12 shows the lighting apparatus of FIG. 11 wherein, upon pivoting the photo slide mounting device upwardly to position 51, light from lamp 1 reflects directly on mirror 3 and can be used as lighting apparatus with lens 48.

As described above, since a single unit can be used as slide viewer, a liquid crystal television, a slide projector, an illuminating light, etc , the invention has the advantage of miniaturized size and multiple utilities and is economical and convenient and it has no idle functions, inasmuch as it is usually used as electric light stand. There is no heat exposed to one's face by reflection on mirror and even if a high power lamp is used, it can be used comfortably and it is possible to quickly and easily enlarge the image of a photo film and liquid crystal television by turning the mirror.

Figure 13:
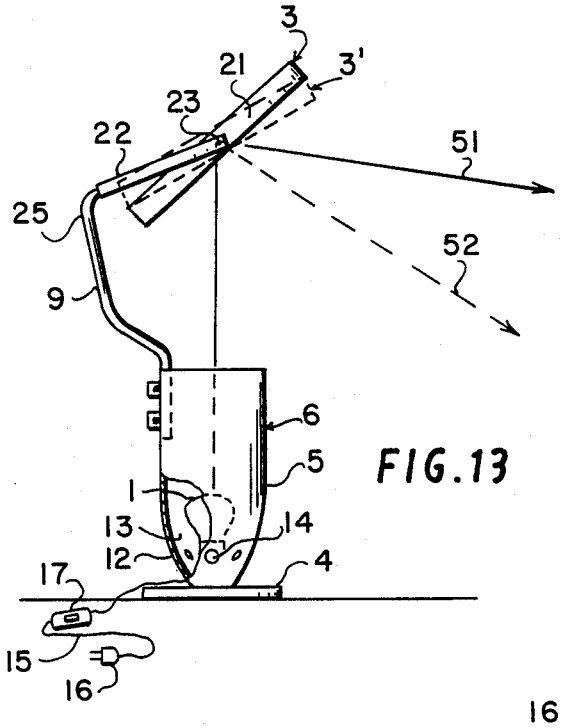
FIG. 13 illustrates the embodiment of the invention wherein the arm supporting the mirror is branched.

FIG. 13 shows the embodiment of the invention wherein the upper portion of the arm 9 branches into two directions to put the opposite sides of frame 21 of mirror 3 between mirror supporting fingers 22, at each end of which a pivot 23 is set.

Mirror 3 is set between pivots 23, expanding the spacing of the pivots 23 the pivots 23 being inserted into diametrically opposite holes 24 of the mirror frame in such a way that the center of gravity of the mirror 3 is substantially at the axis of pivots 23, in order to freely turn the mirror 3 but enabling stopping it at any desired position. By making the axis of inclination of the mirror 3 meet substantially the central axis of light radiation, even when the mirror 3 inclines at various angles such as 3 to 3' for instance and the light direction changes from 51 to 52, radiation from the light radiating device continues to reflect and irradiate most efficiently.

By aligning the center of gravity of the mirror substantially with the rotating axis of mirror 3 as described above, it is possible not only to change the angle of the mirror 3 by lightly touching it with a fingertip, but also to stop the mirror at any angle, resulting in no necessity for the use of adjusting screws or fixing it with washers, etc. and it is possible to shine the light in any desired direction and area.

Since the single mirror supporting pole has supporting fingers branched in two directions at its top as described above, the invention simplifies the alignment of the light axis of radiated light generating device with the center of the mirror, and the adjusting of efficient reflection of light regardless of the angle of the mirror Disassembly and packaging of the whole body can be done quickly, inasmuch as the mirror can easily be separated.

Figure 15:
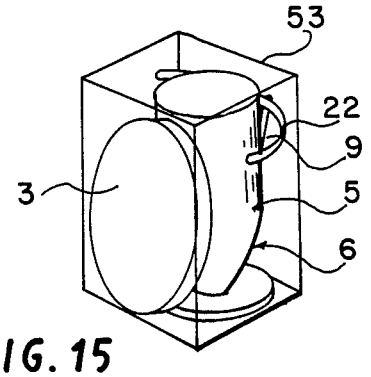
FIG. 15 illustrates the lamp of the invention disassembled and packed in a box.

FIG. 14 shows the embodiment of the invention wherein the mirror device comprising arm 9, mirror frame 22 and mirror 3 can be disassembled from the light radiating device 6 and these members can be reassembled to one unit. When the unit is disassembled into separate parts of mirror 3, the light source device 6 and the arm 9 and these members are packed neatly in a carton 53 as shown by FIG. 15, for instance, it is possible to reduce the volume of the packing carton to approximately ¼ compared with the packing of the complete unit without disassembly as shown by FIG. 14. This is very advantageous for transportation and storage.

Figure 16:
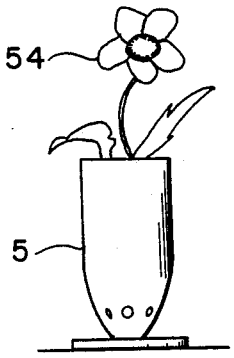
FIG. 16 illustrates the use of the cylindrical body of the lamp of the invention as a vase.

When the mirror is removed, the cylindrical body 5 can be used as a vessel to put flowers 54 in, as shown in FIG. 16.

FIG. 17 shows the embodiment of the invention wherein the lower portion of cylindrical body 5 enclosing light source device 6 tapers inwardly in the downward direction to make a slope 12 where vents 14, 14' are open to the gap 13 between the inside of cylindrical body 5 and lamp 1. The heat of lamp 1 produces air stream 55 which rises upward from vents 14, 14', by the chimney effect produced by the chimney open to the upper mouth of the cylindrical body 5 through gap 13 within cylindrical body. This mechanism makes possible the cooling of the cylindrical body 5, lamp 1, etc so as not to be overheated. Even a single line of vents 14 is effective for this purpose.

Table 1 shows the temperatures measured at the position 56 of the apparatus of FIG. 1, whose dimensions are referred to in Table 2, compared with standard temperatures. This data shows that, in spite of the use of a high temperature minikrytonref 50W bulb in the cylindrical body, the cylindrical body, etc. are efficiently cooled by the chimney effect and the temperature is significantly reduced.

TABLE 1

Lamp: 50W Room Temp: 29.1° C.

| Measured Point | Position | Measured Temp. C. | Temp. Rise C. (Measured Temp.-Room Temp.) | Temp. Rise C. Standard | Judgement |
|---|---|---|---|---|---|
| 56 | Center of Concave Mirror | 40.9 | 11.8 | 50 | Pass |
| 57 | Upper End of Cylindrical Body | 67.8 | 38.7 | 50 | Pass |
| 58 | Cylindrical Body | 68.8 | 39.7 | 50 | Pass |
| 59 | Cylindrical Body | 66.2 | 37.1 | 50 | Pass |
| 60 | Cylindrical Body | 64.6 | 35.5 | 50 | Pass |
| 61 | Cylindrical Body | 62.3 | 33.2 | 50 | Pass |
| 62 | Cylindrical Body | 60.2 | 31.1 | 50 | Pass |
| 63 | Metal Parts | 91.4 | 63.3 | 135 | Pass |
| 64 | Cable | 56.7 | 27.6 | 55 | Pass |

TABLE 2

| Length | Description | Distance (mm) |
|---|---|---|
| A | Distance of Temperature Measuring Points on Cylindrical Body | 25 |
| B | Inside Diameter of Cylindrical Body | 90 |
| C | Aluminum Plate Thickness of Cylindrical Body | 1.5 |
| D | Overall Height of Cylindrical Body | 180 |
| E | Outside Diameter of Bottom of Cylindrical Body | 28 |
| F | Height of Vent | 32 |
| G | Diameter of Vent (8 pcs.) | 8 |
| H | Distance between Upper Line and Horizontal Face of Mirror | 174 |
| J | Diameter of Mirror | 180 |

The invention prolongs lamp life, is safe to handle with no fear of burning and does not cause painted film peeling by heat but withstands lengthy usage due to the cooling produced by the chimney effect as described above.

The cooling mouth of this apparatus produces and cools the air stream flowing from the gap 23 to the open mouth of the cylindrical body 5 by the chimney effect. The cooling mouth is provided on the sloped surface 12. The sloped surface 12 is so wide that it is possible to enlarge the hole size or increase the number of holes in order to definitely accelerate cooling by the chimney effect.

It is difficult for dust to enter the cylinder through hole 14, and easy for it to come out of the cylinder. Since the lower portion of cylindrical body 5 tapers, it is easy to carry the apparatus by grasping the lower portion thereof.

As shown by FIG. 18, for instance, when a straight side apparatus has vents 66 arranged at the lower portion of the cylindrical body 65, with the holes arranged laterally, the apparatus has a lesser chimney effect, poor appearance by increasing size and number of holes, and dust entering the holes has a tendency to accumulate inside of the lamp.

As shown by FIG. 19, in an apparatus which has holes 67 on the bottom of straight sided cylindrical body 65 and is fixed on base plate 4 by pole 68, the cylindrical body is held floating above the base plate Supporting strength is thereby decreased and the bottom area is less as compared with the sloped face of the invention, resulting in a poor chimney effect. The present invention unexpectedly overcomes the disadvantage of the devices of FIGS. 18 and 19.

Figure 20:
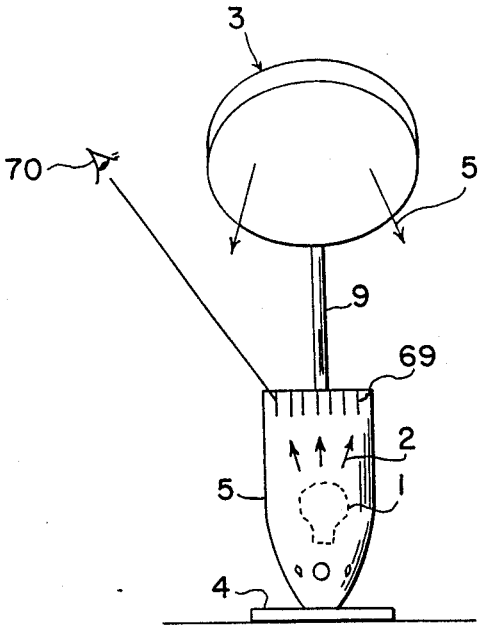
FIG. 20 illustrates a modification of the invention wherein fins are provided in the top of the cylindrical body.
Figure 21:
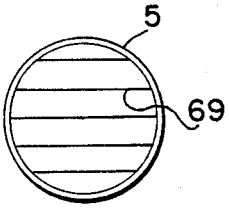
FIGS. 21, 22 and 23 illustrate various modifications of the fins that may be employed.

FIG. 20 shows the embodiment of the invention wherein a number of louvers 69 of long, narrow and thin plates are mounted vertically and in parallel with one another in the open mouth of cylindrical body 5, as shown by FIG. 21. When light 2 from lamp 1 hits a user's lowered eye 70, it dazzles the eye, but in this case, light 2 of lamp is blocked from the eye 70 because of louver 69. Light 2 of lamp passes through the louver 69 and reflects on mirror 3 to become illuminating light 51.

Figure 22:
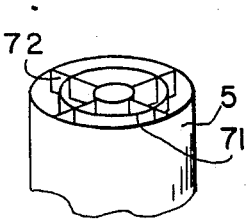

FIG. 22 shows an embodiment of the invention wherein a louver 71 of thin plate is mounted vertically and concentrically in the open mouth of the cylindrical body 5 via radial fins 72.

Figure 23:
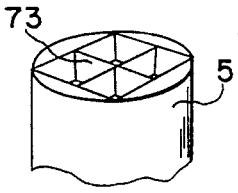

FIG. 23 shows the modified arrangement of the invention wherein four corners of louver 73, in the pattern of a latticework, are fixed within the cylindrical body 5.

This invention makes possible the elimination of dazzling from the light source because the brightness of reflected light is made uniform by the louvers provided between the light source and reflecting mirror.

Figure 24:
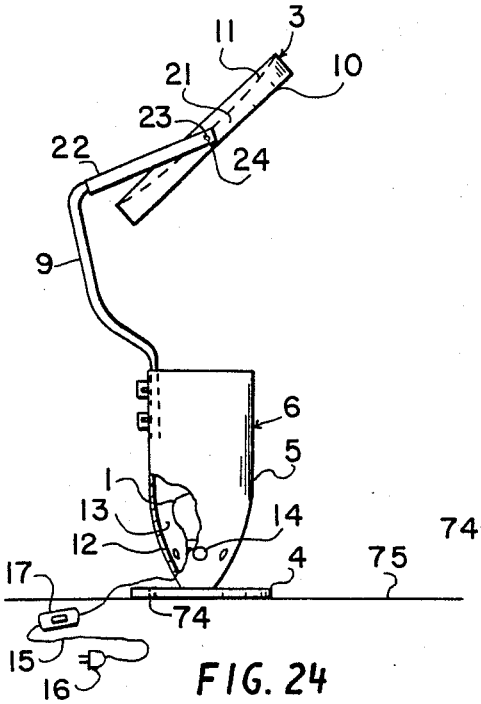
FIG. 24 is a simplified side view of a modification of the lamp of FIG. 1, providing a mounting hole in the base.
Figure 26:
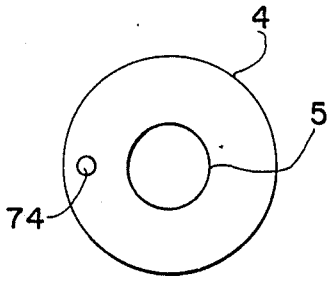
FIG. 26 is a simplified top view of the base of the lamp of FIG. 24.
Figure 25:
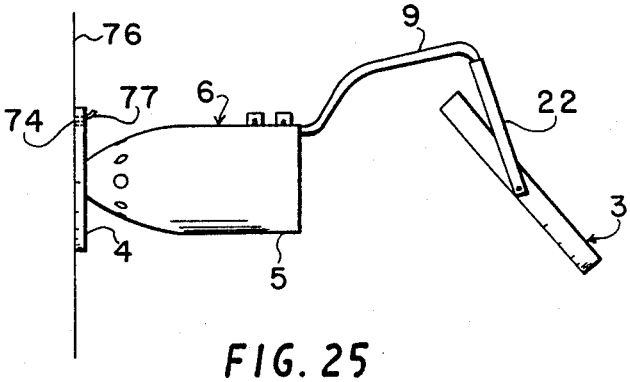
FIG. 25 is an illustration of the lamp of FIG. 24 mounted on a wall.

FIGS. 24 through 26 show an embodiment of the invention wherein a hole 74 is provided on a base stand 4 as shown by FIG. 26. When placing the lamp on a desk 75 as shown by FIG. 24, it stands straight up, but when mounting it onto wall surface 76, as in FIG. 25, it turns sideways. It is mounted on the wall in such a way that a hook 77 on the wall catches the hole 74. The hole is located on upper portion of base stand 4 when it is placed vertically, and the back side of the base stand 4 contacts the wall surface 76. Hole 74 preferably has a concave shape to catch the hook, etc. on the wall 76, or pierced plate or hook implanted into the back side of base stand 4 is good, which are pulled up to catch on hook on wall. It is alternatively possible to use a suction cup or other sticking device on the back side of the base stand 4 to hold the clamp fast on the wall 76.

The invention thus makes it possible not only to light a desk top by placing the lamp on a desk but also to direct light from above by fixing it on a wall or illuminating the room with no desk, etc from a wall surface.

By placing a single unit at various position such as horizontal, vertical, low, high, etc., it is possible to greatly change the lighting of an area and angle of light. Other various modifications other than the above-described examples can be employed, but all of these modifications are included into this invention.

Figure 27:
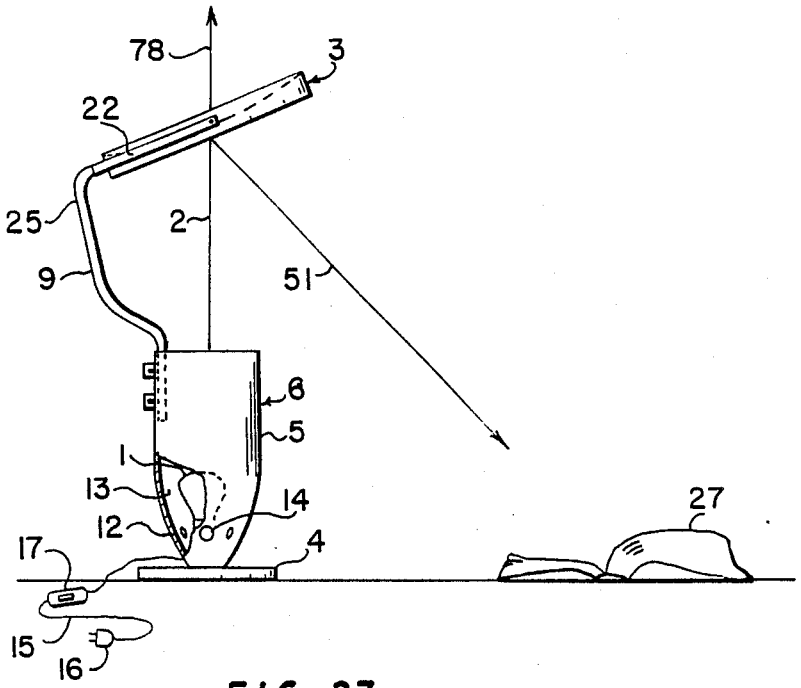
FIG. 27 is a simplified illustration of a modification of the invention wherein the lamp is a halogen lamp.

FIG. 27 shows the embodiment of this invention wherein light source lamp 1 is a halogen lamp of small size and high efficiency and mirror 3 is dichroic mirror which reflects visible light and filters heat. Consequently, reflected light 51 from light 2 of lamp 1 becomes soft visible light by eliminating almost 80% of the heat. When reading a book 27, etc. with this light, for instance, heat does not hit the eye and head, consequently increasing brain activity and reading efficiency without the light heating the eye and head.

FIGS. 28 through 31 show the embodiment of the invention wherein mirror 3 turns on pivot 23 as a center and the opposite sides of the mirror 3 are a plane mirror and a concave mirror, respectively, by which it is possible to send heat 79 from lamp 1 in various directions to various areas. The light source in this case may be a heat lamp.

Figure 28:
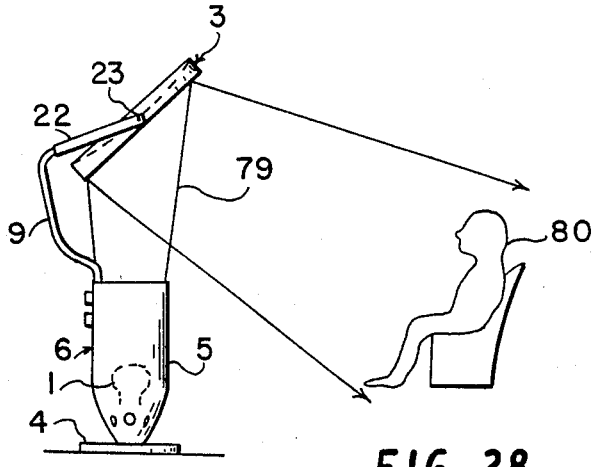
FIG. 28 illustrates the use of the lamp with a heat generating source.

FIG. 28 shows the arrangement wherein heat 79 from heat radiating device is spread and irradiated on the whole body of a man 80 via plane mirror 3.

Figure 29:
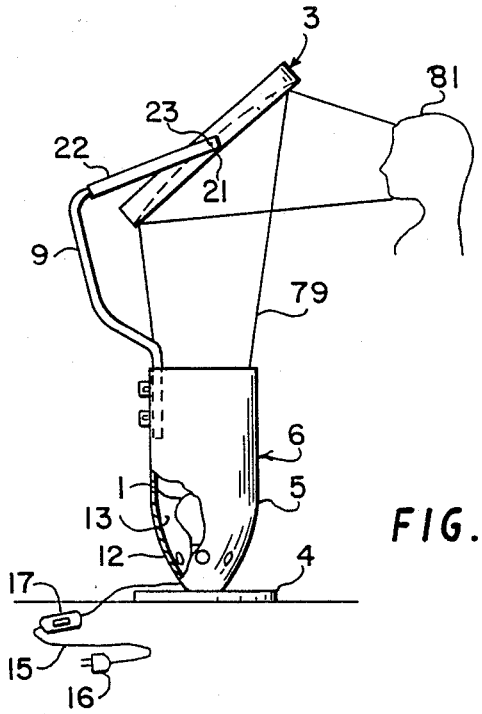
FIG. 29 illustrates the use of the lamp of FIG. 28 to concentrate heat generated in the lamp.

FIG. 29 shows the arrangement wherein heat 79 is sent concentrically to face 81 via concave mirror 3 of heat radiating device in order to treat a pack for face skin care. Alternatively it is advantageous to employ the device to warm one's feet.

As described above, the invention can send heat to any desired direction and area according to objects to be irradiated.

Figure 30:
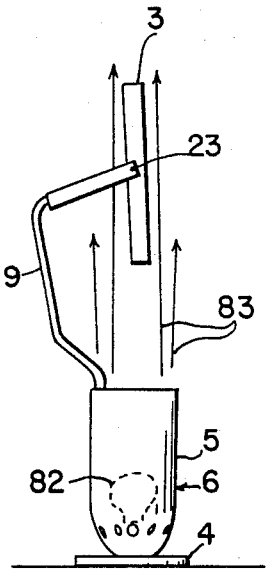
FIG. 30 illustrates the use of the lamp of FIG. 28 in heating a room.

FIG. 30 shows the arrangement of the invention wherein an entire room is heated by convection of heated air 83 from an infrared lamp 82 in the device upward through the rotated mirror 3.

Figure 31:
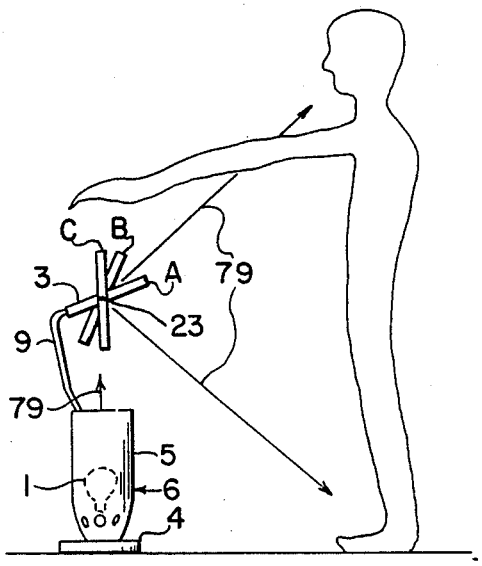
FIG. 31 illustrates the use of the lamp of FIG. 28 in heating various portions of a person's body.

FIG. 31 shows the arrangement of the invention wherein heat 79 can be directed to upper or lower directions; at position A of the mirror 3 heat is directed downward, at position B it is directed obliquely upward, and at position C it is directed straight up. This feature is not possible with conventional heating apparatus.

Figure 32:
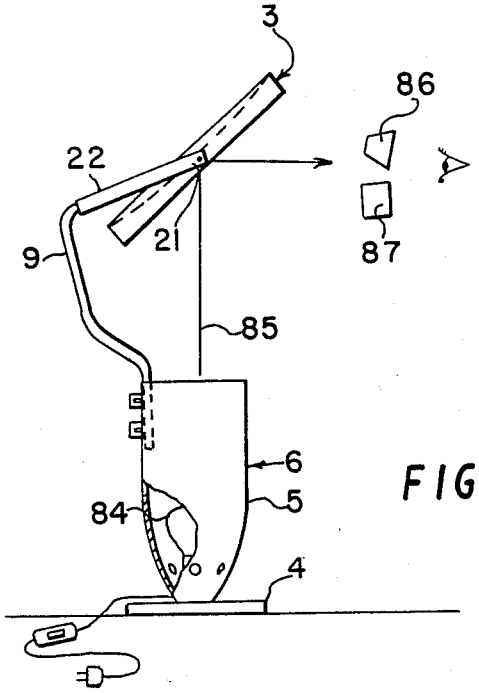
FIG. 32 illustrates use of the lamp of FIG. 1, with a black light or high pressure silver lamp, for inspection and evaluation of objects.

FIG. 32 shows the embodiment of the invention wherein light 85 of a high pressure silver lamp or black light 84 is reflected on mirror 3 and inspection and evaluation are effected by placing and shining tested subjects 87 such as diamond or dust in the path of its reflected light. It is possible in this arrangement to fully observe tested subjects with no heat of the lamp on one's head.

Figure 33:
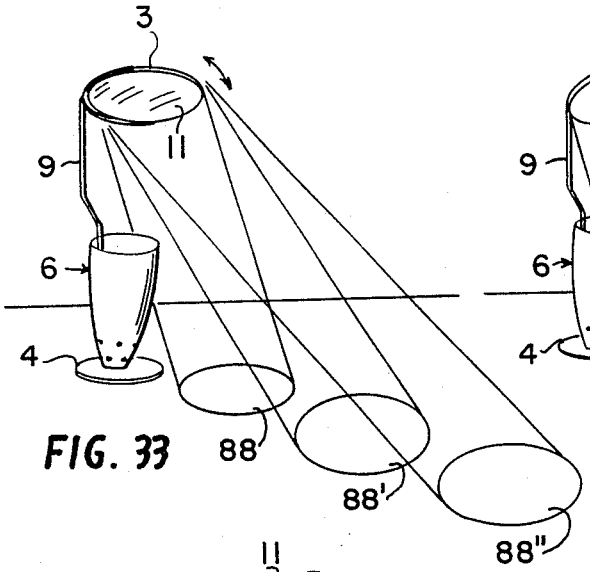
FIG. 33 illustrates the use of the lamp in varying the position of a spot.
Figure 34:
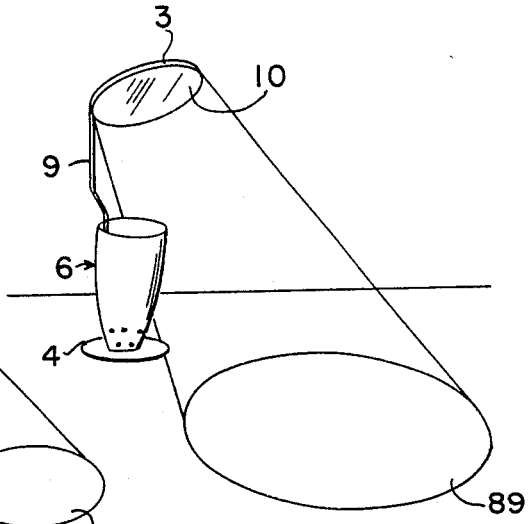
FIG. 34 illustrates the use of the lamp of FIG. 1 in generating a large spot.

FIG. 33 and FIG. 34 show the arrangement of the invention wherein it is possible to switch the light of a light spot 88 by concave mirror 11 to positions 88' and 88" and to spread light by plane mirror 10 by rotating the mirror 3. The lamp is mounted upwardly on its stand 4.

Figure 35:
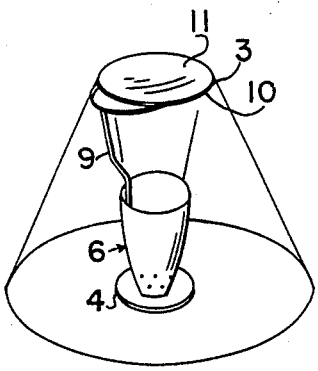
FIG. 35 illustrates the use of the lamp of FIG. 1 as a mood light.
Figure 36:
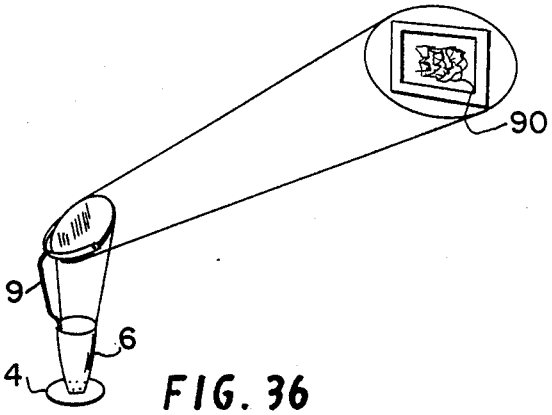
FIG. 36 illustrates the use of the lamp of FIG. 1 in illuminating a picture.

FIG. 35 shows the arrangement of the invention wherein reflected light from the plane mirror 10, with the mirror 3 set at a horizontal position, forms a mood light. In FIG. 36 the lamp illuminates a picture 90.

Figure 37:
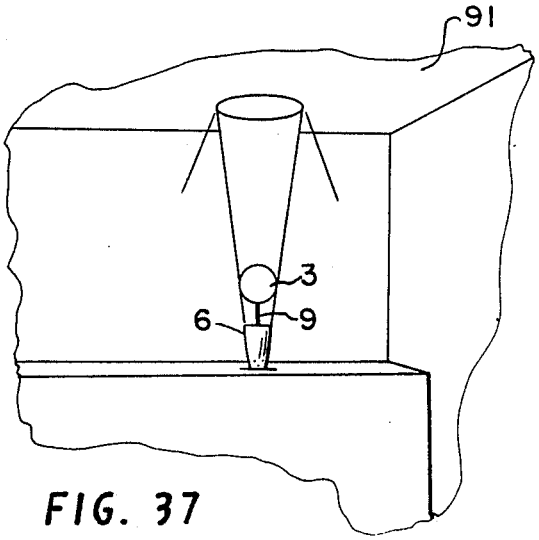
FIG. 37 illustrates the use of the lamp of FIG. 1 for indirect lighting.

FIG. 37 shows the arrangement of the invention wherein the mirror 3 is set at vertical position, so that light shines on the ceiling 91, to provide indirect light. The lamp of the invention can also be used with a floor stand.

Figure 38:
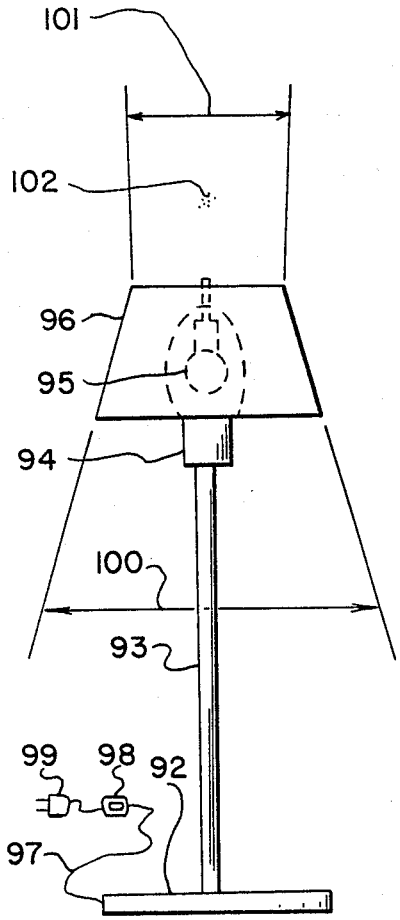
FIG. 38 illustrates the inefficient use of known light shade structures.

FIG. 38 shows conventional floor stand wherein a pole 93 stands on a floor stand 92 and has a socket 94 and a bulb 95 at its upper portion covered by a shade 96. In order to supply electric current to the bulb 95, a switch 98 and a plug 99 are connected to the cord 97 coming from the floor stand 92. This floor stand has such disadvantages that the lighting area 100 from shade 96 is limited, light 101 spreading upward from shade 96 is wasted and dust 102 accumulates on the bulb 95.

The invention provides an improved floor stand that overcomes these disadvantages of conventional floor stands.

Figure 39:
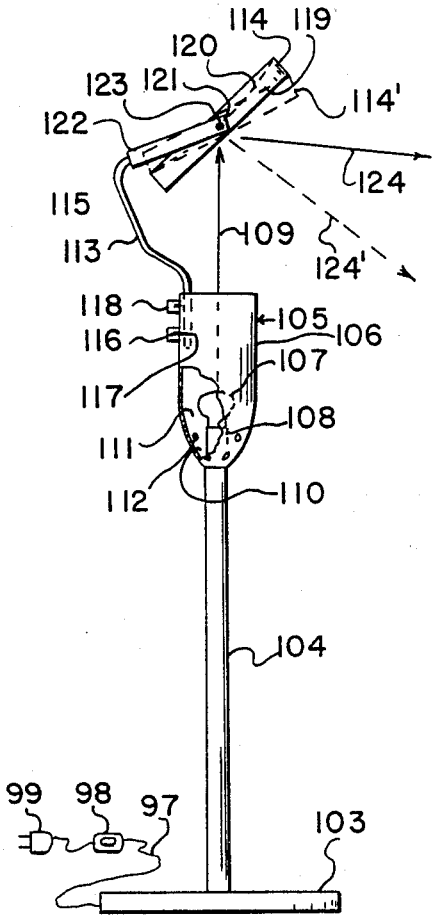
FIG. 39 illustrates a further embodiment of the invention wherein the lamp device of FIG. 1 is mounted on a pole.

FIG. 39 shows an embodiment of the invention wherein lighting device 105 (as in FIG. 1) is set on the upper portion of a pole 104 mounted on a floor stand 103, to be above the eye level of a sitting person. This lighting device 105 accommodates a bulb 107 and a socket 108 within the cylindrical body 106 that opens upwardly to radiate light of bulb 107 as up-rising light 109. The lower portion of the cylindrical body 106 tapers to make a slope 110 having a vent 112 open to gap 111 between the cylindrical body 106 and the bulb 107. The movable reflecting mirror 114 is supported by arm 113 for free rotation and comprises a mirror 114 that covers the lighting device 105.

Two screws 116 extend from the lower portion of arm 113 through holes 117 in the cylindrical body 106. The screws 116 extend to the outside of the cylindrical body and are tightened by nuts or knobs 118 to fix the arm 113 onto the cylindrical body 106.

One side 119 of the mirror 114 is a plane mirror and the other side 120 is a concave mirror. The upper portion of the arm 113 forms a mirror supporting frame 122 branched in two directions to hold the mirror frame 121 from both sides. Pivot pins 123 extend inwardly of the two branch tops and are inserted into opposed holes on a diameter of the mirror frame to freely incline mirror 114 on pins 123 and enable it to stop at any desired position.

Light 109 from the lamp 107 of the lighting device projects upward, e.g., above the eye, reflecting on mirror 114 to become irradiating light 124 changing its lighting direction downwardly. When rotatable mirror 114 is moved to position 114', the light changes to lighting direction 124'.

It is alternatively possible to change the lighting area by using either the plane face 119 or the concave face 120 of mirror 114'. For instance, the plane mirror 119 of mirror 114 may be used to illuminate a wide area, and the concave mirror 120 of mirror 114 may be used to illuminate a narrow area. These examples show that lighting the position changes according to the angular displacement of the mirror 114.

The invention, when compared with with conventional combinations of lamps and stands, does not require a large shade, etc. above the stand but has stable feeling because of the use of a small mirror. It can prolong the lamp life by inhibiting dust from entering the lamp by the mirror covering lighting device, since heat of the lamp is well spread by the chimney effect of the air stream rising up from the vent within the cylindrical hollow to cool the lighting device. In addition, the invention has no wasteful flow-out of light but can work with lower electric consumption.

The invention also provides remarkable features, not provided in conventional floor stands, such as no dazzling, since the light shines from a higher position than the eye when a person is sitting.

The light may be used as a lantern by shining it on a lower portion than the plane mirror by setting the mirror at a horizontal position.

The light may be directed upwardly on the ceiling of a room by setting the mirror at a vertical position.

Figure 40:
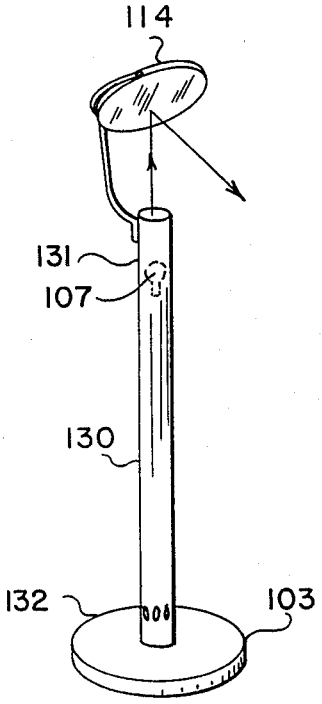
FIG. 40 is a perspective illustration of a modification of the lamp of the invention incorporating a pole.

FIG. 40 shows the use of this invention wherein there is provided a single unit of the pipe 130 and the vent 132 open to the gap 131 between the lamp 107 and the inside wall of pipe, at the lower portion of pipe 130, in order to increase the chimney effect to spread the heat of lamp 107.

Figure 41:
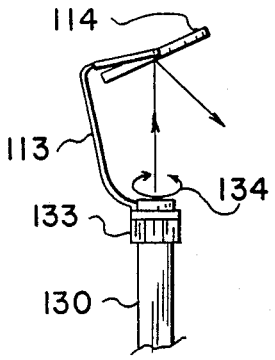
FIGS. 41 and 42 are simplified illustrations of an embodiment of the invention wherein the mirror is rotatable about a vertical axis.

FIG. 41 shows the embodiment of the invention wherein one piece of the arm 113 supporting the mirror 114 of movable mirror device is attached to a grip 133 into which the upper portion of the pipe 130 is inserted for free rotation in a horizontal plane whereby the lighting direction of the mirror 114 can be changed by rotational movement in the direction 134 of the grip 133.

Figure 42:
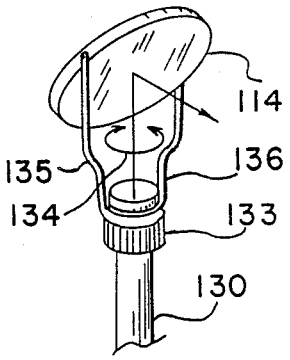

FIG. 42 shows the use of the invention wherein the upper end has two arms 135, 136 attached to grip 133, for holding both sides of the mirror 114.

Figure 43:
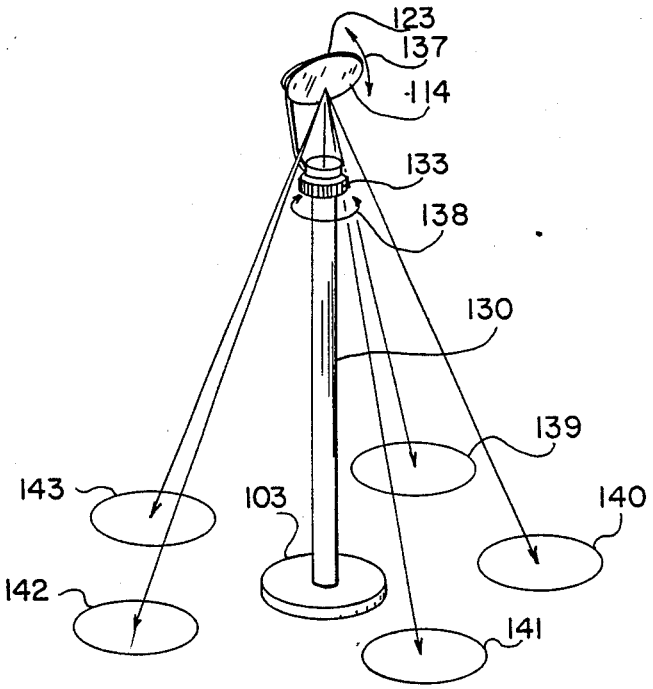
FIG. 43 is an illustration of the rotation of the mirror about a vertical axis.

FIG. 43 shows the use of the invention wherein the lighting area can freely be changed to wider spots such as 139, 143, for instance, by moving the arm 113 supporting the mirror 114 or the portions 135, 136 of the arm 113 on the upper end of the pipe 130 as described with reference to FIG. 42, and by movement in the direction 137 of the mirror 114 on the horizontal axis of pins 123 and movement in the direction 138 of the mirror 114 along the vertical axis of the pipe 130, with the pipe 130 and floor stand 1 fixed as described with reference to FIG. 43.

Figure 44:
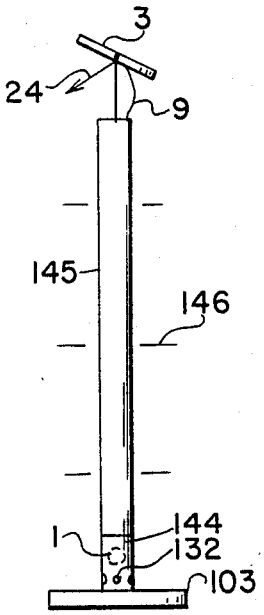
FIG. 44 illustrates a modification of a pole lamp in accordance with the invention, with different pole structures.

FIG. 44 shows an embodiment of the invention wherein a transparent pipe 144 with a bulb 1 built therein defines a light generating device and floor stand at the lower portion of a transparent or translucent bar pole 145. The heat of bulb 1 is cooled by the chimney effect resulting from the air stream which is produced in pipes 144, 145 via vent 132. The light of the bulb 1 is reflected by the movable reflective mirror 3 supported by the arm 9 at the upper end of the pole 145 to become illuminating light 146. Transparent or translucent pole 145 glows to produce illuminating light 146 which comes from pole 145. Instead of a transparent pipe 144, a translucent pipe may be used and also a clear pole such as crylic resin, etc. or pipe containing a bundle of optical conductive fibres such as glass fibres, etc. may be used for pole 145. A light collecting mirror such as a regular mirror or dichronic mirror is set directly underneath lamp 1.

The bulb 1 and vent 132 may be at the lower portion of the opaque pipe 147.

Figure 74:
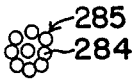
FIG. 74 is a partially cross sectional view of another embodiment of the invention.
Figure 75:
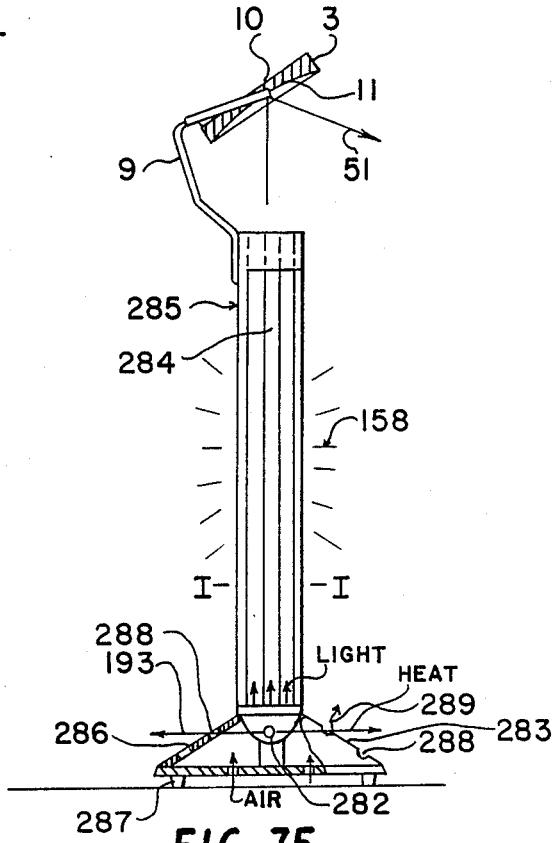
FIG. 75 shows a section taken along line I—I in FIG. 74.

FIGS. 74 and 75 show an embodiment of the invention which is an application to a floor stand and wherein pole 285 having bar 284 of transparent acrylic resin therein is set on a flat cover 283 where lamp 282 is mounted, and mirror 3 of plain surface 10 on one side and concave surface 11 on another side is supported on arm 9 set at the upper portion of the pole 285. Dichronic mirror 286 is set within cover 283 to collect the light of lamp 1 on the lower end surface of pole 285, the bottom surface of case 283 has extended stands 287 to contact the floor, vents 288 are set on the upper and lower surface of case 283 to release the heat of lamp 1 as hot rays 193 and as a hot air stream 289. The light of lamp 1 passes through transparent pole 285 and is reflected on mirror 3 to become illuminating light 51. On this occasion, the pole 285 passing light grows to produce spreading light 158 from the surface of pole 285. Lamp 1, for example, is a lamp which is 24V, 150W and is of a small type and produces strong light.

Figure 45:
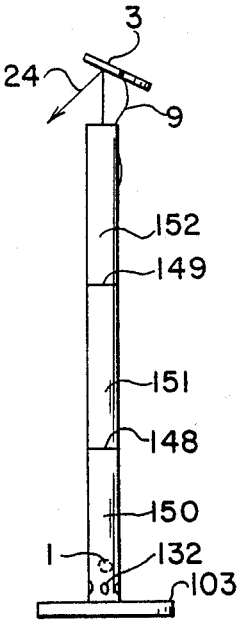
FIGS. 45 and 46 illustrate a pole lamp in accordance with the invention with various pole sectioning arrangements.
Figure 46:
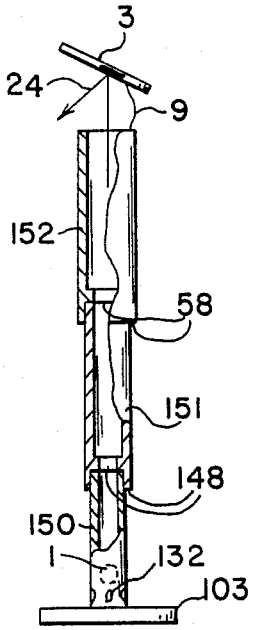
Figure 58A:
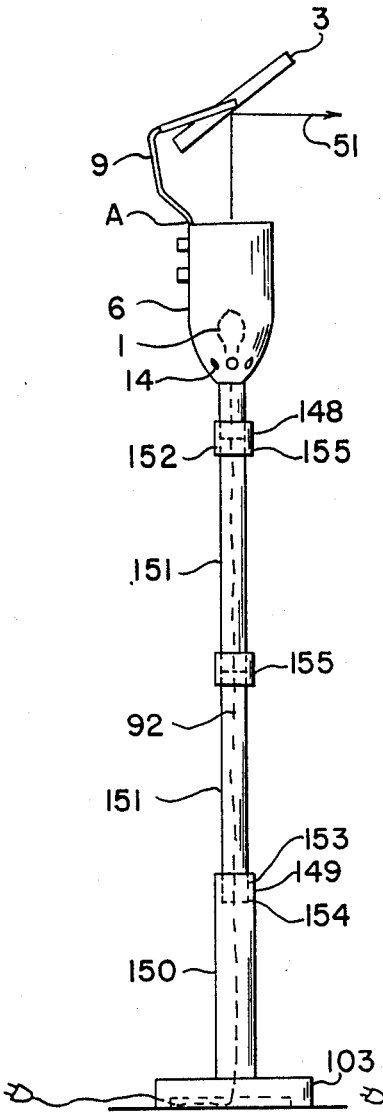
FIG. 58 is a side view of another embodiment of the invention.
Figure 58B:
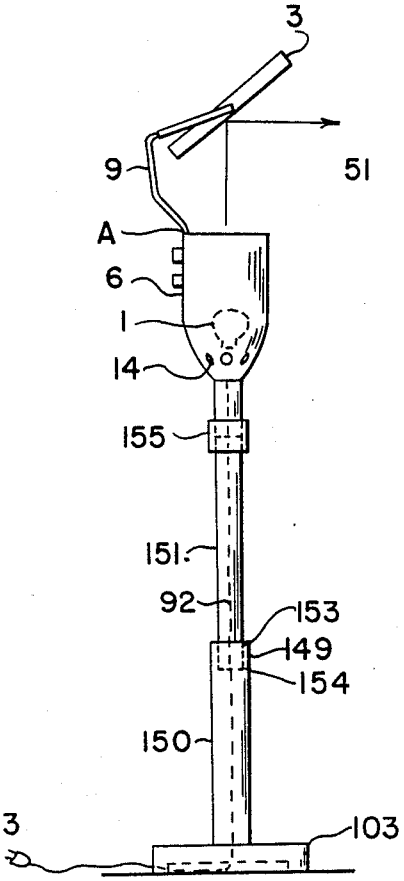

FIG. 45 and FIG. 46 show an embodiment of the invention wherein the pipes 145 and 147 have splicings 148 and 149 to be separated into three sections 150, 151 and 152. These splicings 148 or 149 are joined by screwing male nut 153 into female nut 154, the nuts 153 and 154 being provided at the ends of each pipe as shown in FIG. 58 or by a ring 155 into which the end of each pipe is inserted, as shown by FIG. 58. The plural numbers of pipes; such as sections 150, 151 and 152, have a wire cord 92 within them, and these pipes can be separated with no trouble at A, 148 and 149 point and disassembled to a reduced size. The lighting height is variable by increasing or decreasing the number of pipes to use as a mini floor stand.

When using an extended joint instead of splicings on the pole, the lighting pole with joints simulates bamboo.

Figure 47:
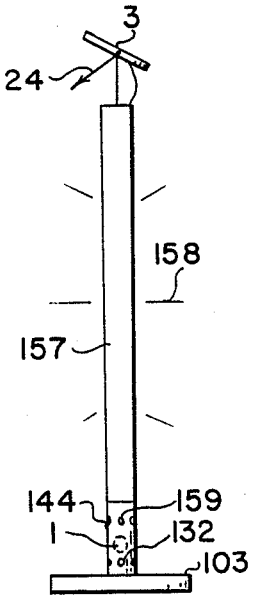
FIG. 47 illustrates the pole lamp in accordance with the invention with a transparent or translucent pole.

FIG. 47 shows the embodiment of the invention wherein the translucent pipe 144 with bulb 1 built therein is set at the lower portion of the transparent supporting bar pole 157 of acrylic plastic, etc. The light of bulb 1 passes through the material of the transparent pole 157 and becomes illuminating light 158 by reflecting on movable mirror 3, or light expanded from the surface of pole 157. In addition, the vents 159 and 132 are set at the upper and lower portions of pipe 144 to radiate the heat of bulb 1.

Figure 48:
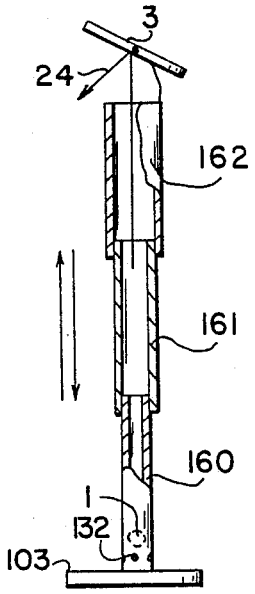
FIG. 48 illustrates a telescoping pole lamp arrangement in accordance with the invention.

FIG. 48 shows an embodiment of the invention wherein the supporting pole is freely expandable and shrinkable, and the diameter of pipe becomes gradually larger to insert each section thereof and to freely extend and shrink pipes 160, 161 and 162. As described above, a stand capable of separation, extension and shrinkage can shorten the entire height of the lamp during transportation, packaging and storage, and therefore, the volume and space can be reduced, resulting in lower cost.

Various modifications other than the examples can be provided such as expansion or shrinkage of the pole, use of various light source and mirror device, combinations of such examples, etc., and all these variations are included within the scope of the invention.

The mounting pole may be comprised of a plurality of pipe sections 150, 151 and 152 being oppositely threaded at their opposite ends, and joined together by screwing. The joints may be very carefully designed, for example, in the form of bamboo joints, in order to hide the joints from view.

A lighting device 105, for example, of the type illustrated in FIG. 1, may be mounted on a pipe section, the pipe section extending into a lower pipe section. The inside of the upper end of the pipe section is lined with rubber, the upper pipe section extending therethrough with friction. As a consequence, the upper pipe section may be moved vertically, to effect the rising and/or lowering of the lighting device, the upper pipe section being held, however, at any set position by the friction of rubber. The lighting device may be supplied with a coiled wire extending internally of the pipe sections, the wire thereby being expandable and shrinkable. Alternatively, of course, the wire may extend externally of the pipe sections, as partially illustrated also in FIG. 1.

Figure 49:
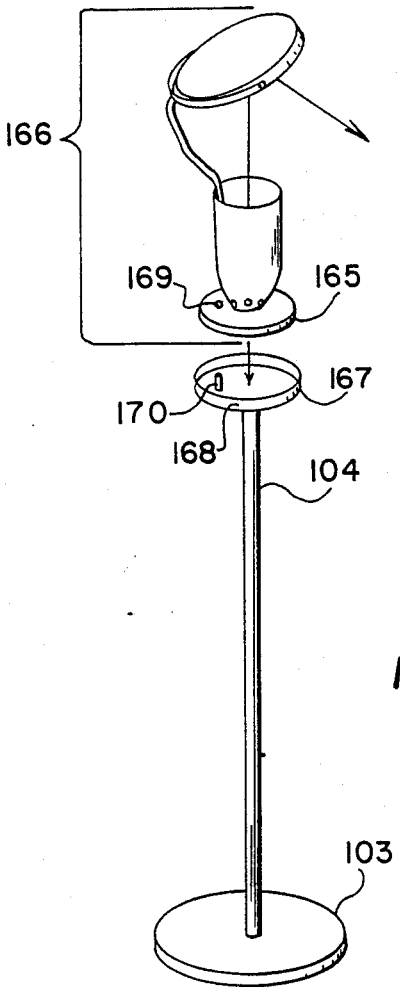
FIG. 49 is a partially exploded view of a further embodiment of the invention.

In the still further embodiment of the invention as illustrated in FIG. 49, a lighting device 166 is provided of the type illustrated, for example, with reference to FIGS. 24–26. The lighting device 166 comprises a base 165 having a pole 169. In order to mount the device on a floor stand, the floor stand comprises a pole 104 mounted on a base 103. A receiving base 167 on top of the pole 104 has an outer rim extending upwardly to define a recess for receiving the base 165 of the lighting device. A pin 170 extends upwardly from the base 167, to be received in the hole 169 of the base of the lighting device. This arrangement enables the lighting device to be firmly held to the pole.

Figure 50:
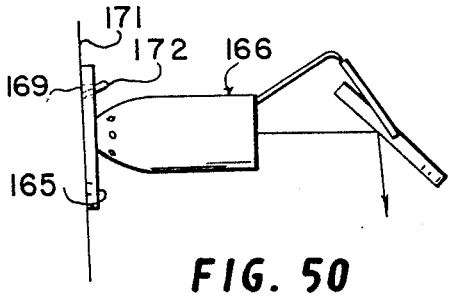
FIG. 50 is a side view of a still further embodiment of the invention.
Figure 51:
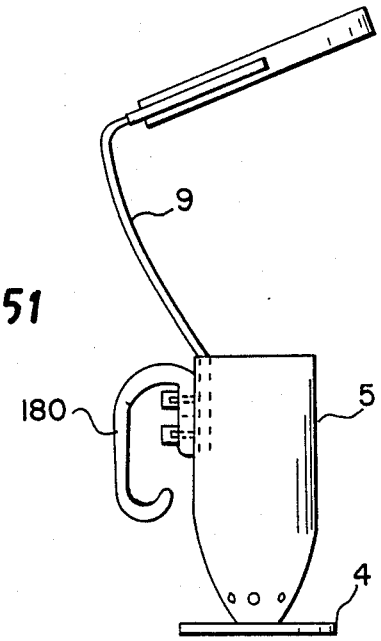
FIG. 51 is a side view of a still further modification of the lamp in assembled condition.

As illustrated in FIG. 50, the lighting device 166 may alternatively be mounted on a wall 171, in a manner similar to that of FIG. 25, with a hook 172 on the wall extending through the hole 169 in the base 165.

In a still further embodiment of the invention, a carrying handle may be mounted to the cylindrical body, for example, on screws. In this arrangement, the handle is held to the device by the nuts.

One side of the cylindrical body 5 may be shaped in the form of a spout, if desired, for ornamental purposes. It is thus apparent that the cylindrical body 5 may have other ornamental shapes, as desired.

Figure 52:
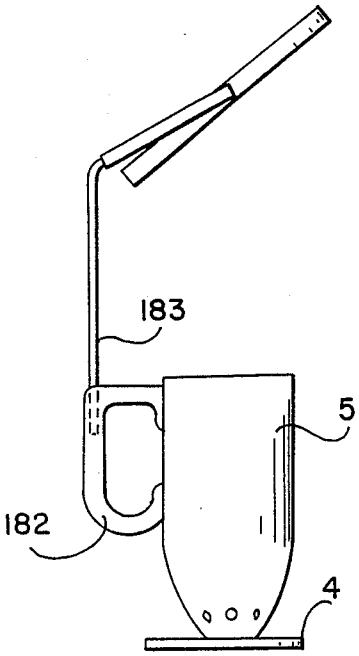
FIG. 52 is a side view of a still further embodiment of the invention.

In the embodiment of the invention illustrated in FIG. 52, the handle 182 is held onto the outside of the cylindrical body 5 by conventional means, such as, for example, screws (not shown) extending through the wall of the cylindrical body 5. In this embodiment of the invention, however, the arm 183 for holding the mirror is threaded into the top of the handle, rather than being held to the interior of the cylindrical body 5 by screws as in the embodiment illustrated in FIG. 1.

A shade hood in the form of a half sphere, may be attached to the upper end of the arm above the mirror. The shade hood has a diameter preferably slightly greater than that of the mirror, the shade hood covering the top of the mirror. This shade hood inhibits dust from falling onto the mirror, as well as inside of the cylindrical body.

Figure 53:
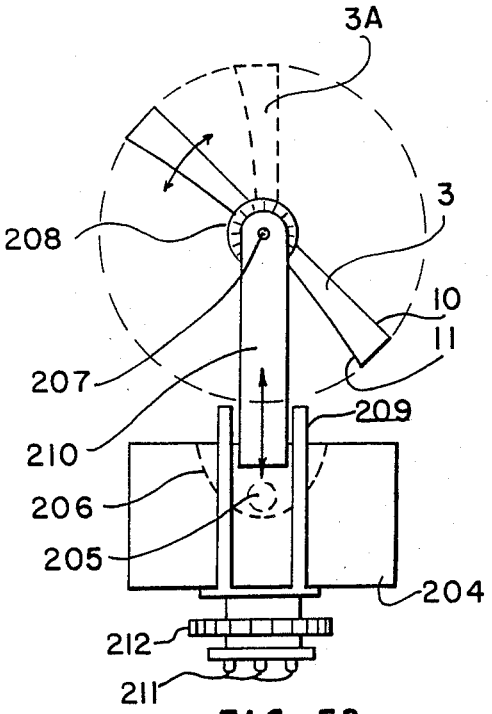
FIG. 53 illustrates a side view of another embodiment of the invention.

FIG. 53 shows this invention in the form of a photostrobe.

FIG. 53 comprises strobe 204, strobe bulb 205, mirror 206 reflecting upwards the light of the strobe bulb and arm 210 which supports mirror 3 to rotate and stop at any desired angle on axis 207 with wave shaped washer 208 changing direction and spreading reflecting light and also which slides up and down along guide 209 for carrying and storage.

Figure 54:
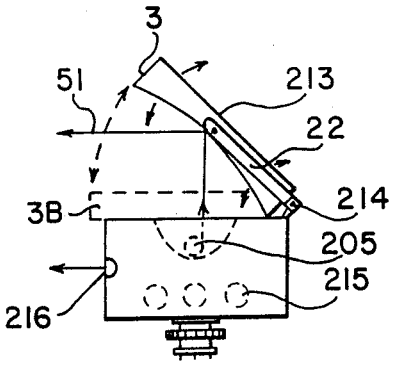
FIG. 54 illustrates a further embodiment of the invention.

FIG. 54 shows an example of this invention wherein frame 22 supporting and rotating mirror 3 on axis 213 supports and closes or opens on axis 214 strobe body 204, and mirror 3 can be collapsed to position 3B by these axes 213 and 214. 215 shows a strobe battery and 216 an infrared lamp for auto focussing distance measurement.

Figure 55:
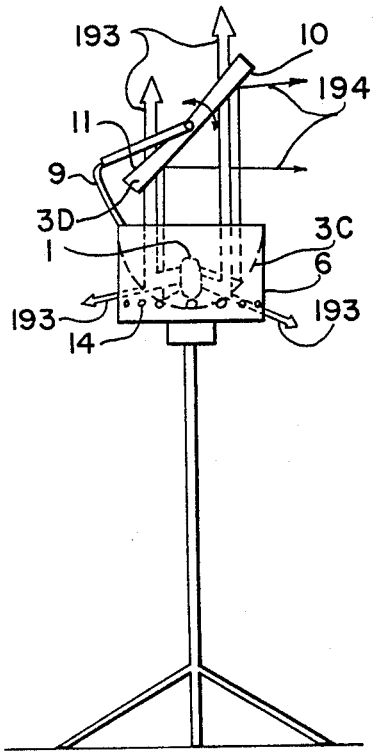
FIG. 55 is a side view of an embodiment of the invention.
Figure 57:
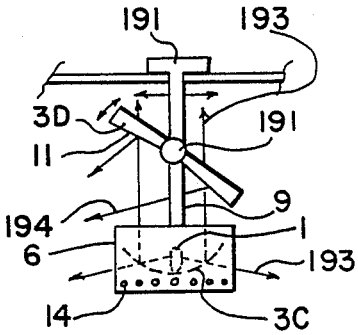
FIG. 57 is a side view of a still further embodiment of the invention.
Figure 56:
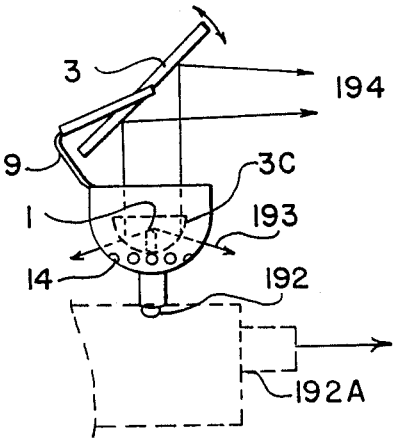
FIG. 56 is a side view of a further embodiment of the invention.

FIGS. 55, 56 and 57 show the invention used for video light.

FIG. 55 shows an example of this invention wherein a dichronic mirror 3C which passes thermal rays from light source 1 and reflects visible light 194 only, removes 60% of the entire thermal rays and further dichronic mirror 30 takes away the remaining 40% of thermal rays. Thus 100% of the thermal rays are removed from light 1 directed onto subject, and compared with only a single dichronic mirror 3C, a performer on TV has no need of being drenched with sweat by receiving thermal rays, resulting in grease paint and make-up coming off.

FIG. 56 shows an example wherein the light source device 6 is attached to a video camera 192A by clip 192.

FIG. 57 shows an example of this invention wherein mirrors 3D are moved by a remote-controlled motor 191 from the floor to change the direction and spread the light 2 by concave surface 11 and plain surface 10 without declining light. By using motor 191, these devices run under the ceiling.

Figure 61:
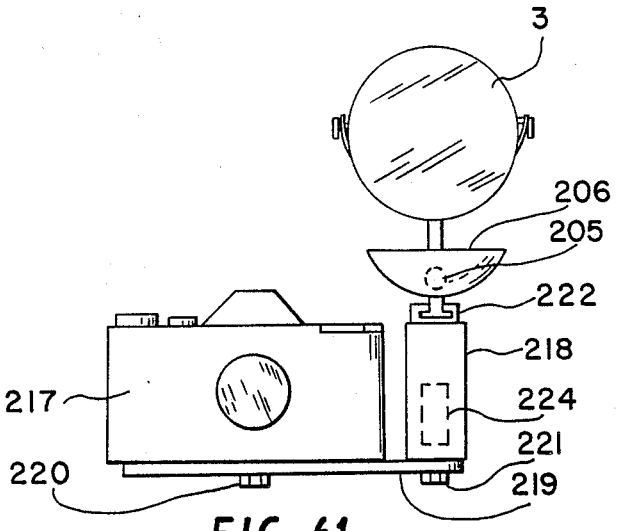
FIG. 61 is an illustration of a front view of another embodiment of the invention.
Figure 62:
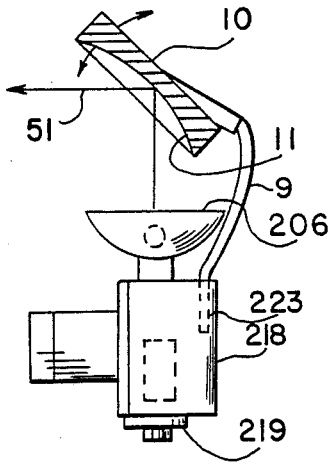
FIG. 62 is a side view of FIG. 61.

FIG. 61 and FIG. 62 show an embodiment of the invention wherein a grip 218 is attached to a camera 217, a hot shoe is set on the grip 218, a mirror reflecting light of strobe light source is mounted on grip 218, camera 217 and grip 218 containing the strobe light are fixed to a grip holder 219 by nuts 220 and 221, strobe bulb 205 and reflecting mirror 206 are set upwards by the shoe grip at the upper portion of grip 218, and mirror 3 reflecting light 51 of strobe bulb 205 is supported on arm 9, the lower end of which is inserted into hole 223 of grip 218. Mirror 3 is comprised of a plain surface on one side and a concave surface on the other side.

Strobe bulb 205 is an Xenon gas bulb and the power source of a chargeable NiCd battery 224 is contained within grip 218.

When carrying these parts, mirror 206 is removed from grip 218 and arm 9 is pulled out from hole 223 of grip 218.

Figure 63:
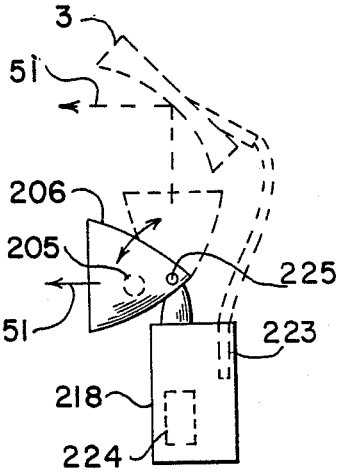
FIG. 63 illustrates a side view of another embodiment of the invention.

As shown in FIG. 63, if the reflecting mirror 206 having strobe bulb 205 at its center is supported on grip 218 so as to move on axis 225, it is possible to direct the light 51 directly from mirror 206.

Figure 64:
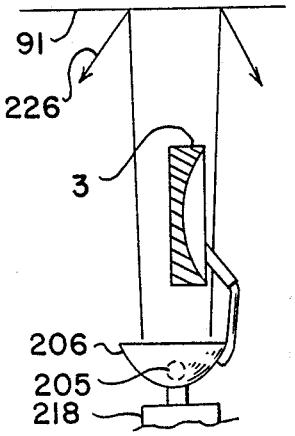
FIGS. 64, 65, 66, and 67 are illustrations of the use of the FIG. 61 embodiment of the invention.
Figure 65:
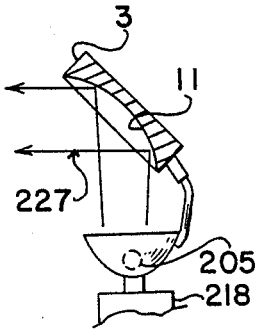
Figure 66:
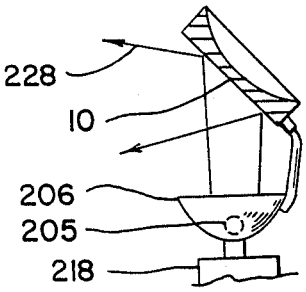
Figure 67:
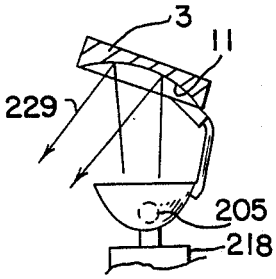

FIGS. 64 through 67 show an embodiment of the invention wherein different lightings can be made by rotating the mirror 3. FIG. 64 shows bounce lighting which can obtain open light 226 by shooting light 51 on the ceiling 91 through the vertically positioned mirror, and FIG. 65 shows spot lighting 227 focussed by a telephoto of the camera by concave mirror 11. FIG. 66 shows spread lighting 228 adJusted for a wide angle photo by plain mirror 10, and FIG. 67 shows downward spot lighting 229 by concave mirror 11 in case of a close-up photo.

Figure 68:
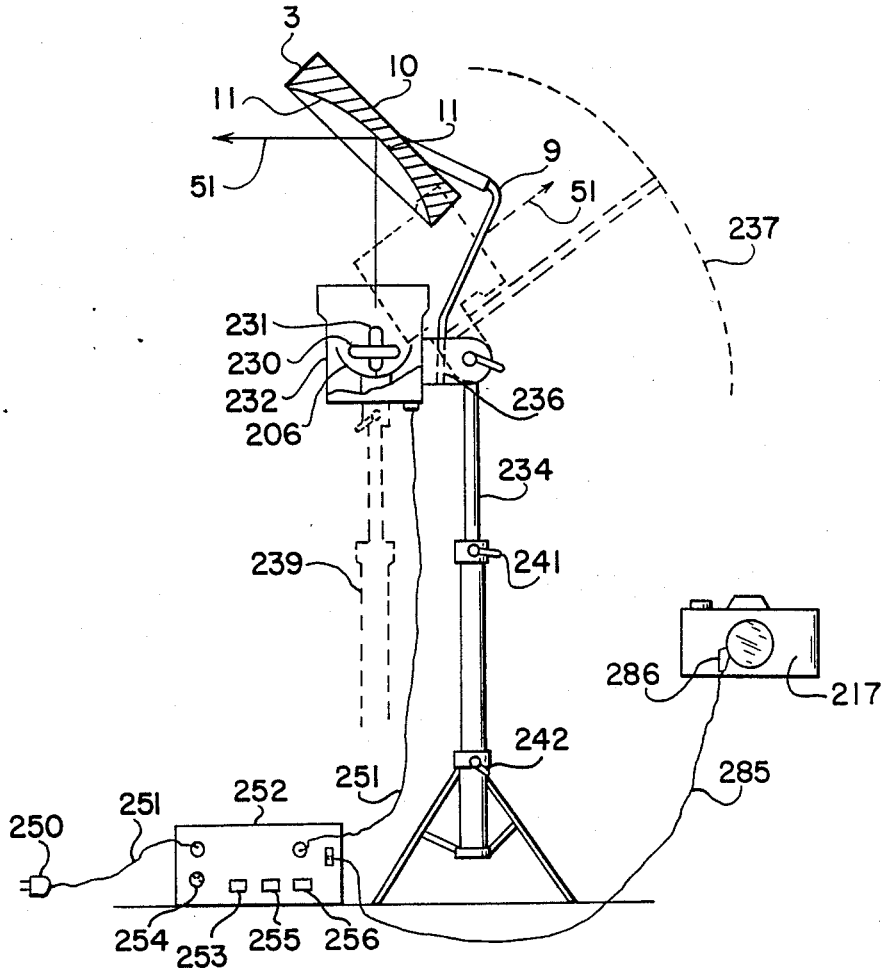
FIG. 68 is a partially cross sectional view of another embodiment of the invention.

FIG. 68 shows an embodiment of the invention which is used with a strobe photo for portrait or commercial photos and wherein reflecting mirror 206 is set underneath a flat ring strobe bulb 230 and modelling lamp 231 set at the center of the strobe bulb, and a handle 233 of a case 232 containing these parts is fixed to a stand 234 by screwing nut 235 to make it possible to incline the case 232.

Mirror 3 is comprised of plain surface 10 on one side and a concave surface 11 on the other side, and the lower end of arm 9 supporting mirror 3 freely moves about axis 23 and is inserted into a hole 236 of the handle 233 so that the center of one mirror could be maintained to meet with the light axis of strobe bulb 230 and molybdenum lamp 231. It is possible to obtain light 51 of changing angle and spread by rotating mirror 3.

In order to spread light, it is possible to insert into hole 236 a shaft of an umbrella 237 instead of arm 9 which is qulled out from hole 236, or it is possible to set umbrella 237 on a portion of the case 232 other than hole 236. Or in order to change the position of light 51, stand 234 may be attached onto the bottom of case 232 to freely recline. Stand 234 can slide up and down case 232 by a releasing grip, or case 232 can move horizontally by releasing lever 242. A plug 250 which sends electric current to power supply source 252 is connected with strobe bulb 230 and molybdenum lamp 231 by a cord 251. Power supply source 252 has a power switch 253 for the molybdenum lamp 231. A strobe lighting switch 252 is also provided. Strobe bulb 230 is, for instance, an amber coating quartz circle tube with 2400 Ws maximum input. For instance, the power source or battery 252 has 2400 Ws maximum output, selectable 2400/1200.800.400.1200 Ws output, light adjustable range of FULL to $\frac{1}{3}$, 3 circuits linear adjustment.

This invention makes it possible to direct the light of molybdenum lamp 231 through mirror 3 to a subject by combining molybdenum lamp 231, strobe bulb 230 and mirror 3 and to accurately look for and determine the correct position of the strobe lighting direction by adjusting the angle of mirror 3 and the lighting position to obtain the desired lighting. This is done by watching the light of molybdenum lamp 231 directed to the subject from mirror 3 and by combining the molybdenum lamp 231, strobe bulb 230 and mirror 3. Once the mirror position has been determined, the photo is shot by lighting strobe bulb 231. In other words, it has become possible to accurately and easily make microscopic adjustment of the spot lighting position of the strobe which was impossible with conventional strobes.

Connector 286 of camera 217 is connected with power supply 252 by synchro-cord 285 to synchronously light the strobe when activating the camera shutter.

This invention has the effect wherein a fine shot is possible by operation of mirror 3. For instance, it is possible to spot key light on the nape in a portrait or to light brightly only a section of cake in a commercial photo, which was not possible heretofore.

Also this invention has the effect in which the strobe lighting from a high position is easily adjusted by moving the mirror, which was available heretofore.

Commercial photography is creative and always looks for new lighting, and the invention enables a photographer to produce an entirely new type of photo.

Figure 69:
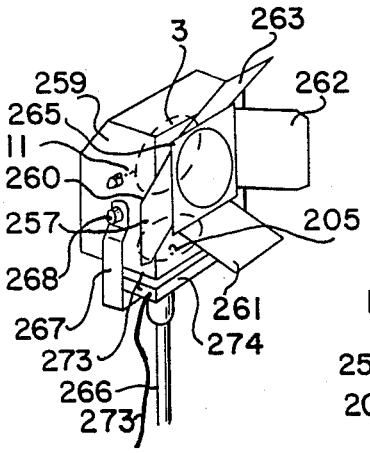
FIG. 69 is a view of another embodiment of the invention.
Figure 70:
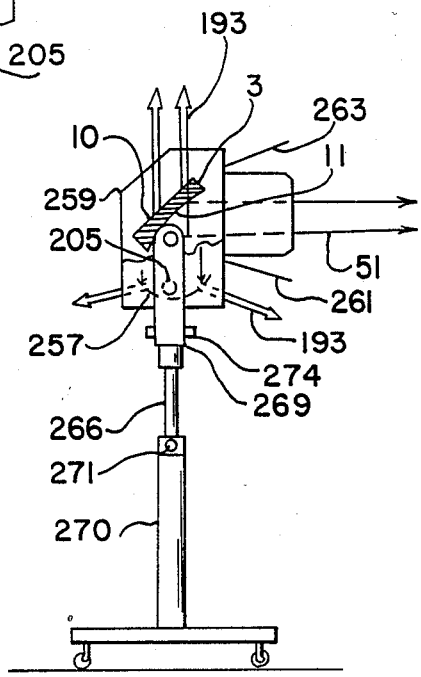
FIG. 70 is a partially cross sectional view of FIG. 69.
Figure 71:
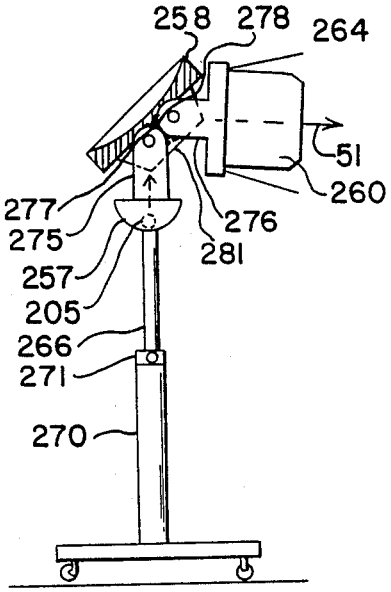
FIG. 71 is a partially cross sectional view of another embodiment of the invention.

FIGS. 69 through 71 show an embodiment of the invention which is an application of lighting for use with video or motion pictures at studios and wherein it is composed of a light source, mirror and bandoor (there are also occasions where the bandoor is not used)

and even if the angle of mirror is changed, the light reflected from the light source on the mirror always passes through almost the center of the bandoor.

FIG. 69 and FIG. 70 show that case 259 contains a light source lamp 205, dichronic mirror 257 collecting light of lamp 205 and, dichronic mirror 258 reflecting light of lamp 205 on its light axis. Mirror 258 has a plain surface 11 on one side and a concave surface 11 on the other side and reflects the light of mirror 257 on either of these two sides as indicated at 51. A hot line or heat 19 of the light source lamp 205 is removed by utilizing dichronic mirrors 257 and 258. Mirrors 257 and 256 are not dichronic on some occasions.

In order to limit the lighting area of light 51, bandoor 264 with 4 plates 260, 261, 262 and 263 is set at the edge of lighting mouth 265 of case 259 to freely open and close. The light source, reflecting mirror and bandoor are built into case 259.

Figure 59:
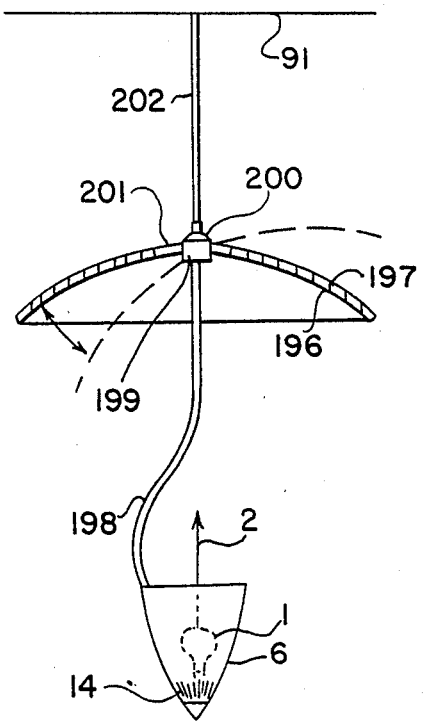
FIG. 59 is a side view of another embodiment of the invention.
Figure 60:
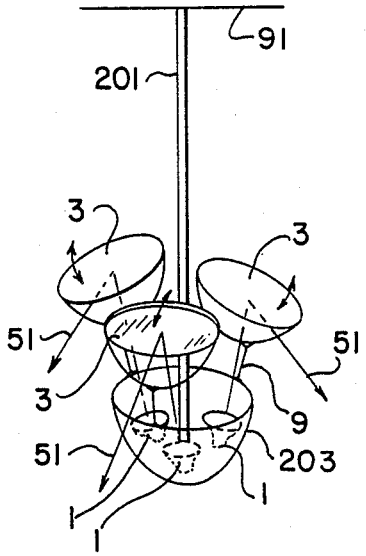
FIG. 60 is a perspective view of another embodiment of the invention.

FIGS. 59 and 60 show an example of this invention using a pendant and chandelier wherein the light source device 6 hangs from ceiling 91.

FIG. 59 is an example wherein mirror 197 has reflecting surface 196 reflecting the light of the light source and a mirror 197 makes it possible to tilt bulb socket 199 on the top end of a pipe arm 198 which supports the reflecting source device 6 and to change the light direction. A swivel 200 and an air window 201 is also shown in FIG. 59. The swivel 200 is set within bulb socket 199 and the entire body of the mirror and the light source hangs from the ceiling by power supply cord 202 extending from the swivel 200. Mirror 197 can incline at any angle in three dimensions. Power supply cord 202 connects with a cord running to light source device 6 within pipe arm 198.

FIG. 60 shows an example of a chandelier which has a plurality of light bulbs 1 in a single cage or reflector 203 for plural mirrors 3.

Figure 76:
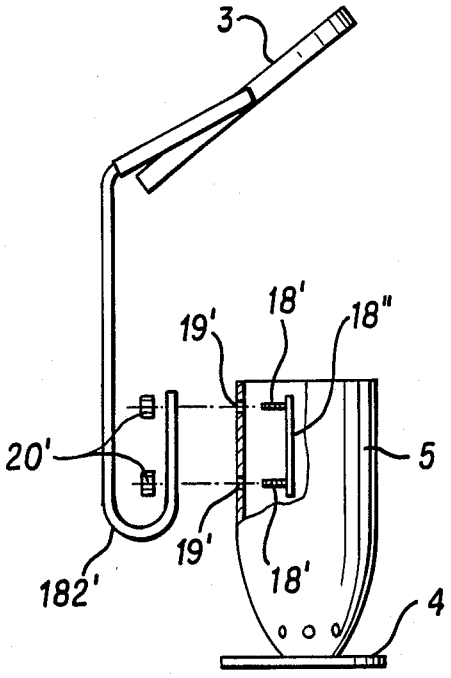
FIG. 76 is an elevational view of a further alternate embodiment.

FIG. 76 shows an alternate embodiment wherein an arm 182' has a U-shaped configuration with two leg portions, one of the leg portions being mounted on the cylindrical body 5 and the other leg portion extending upwardly for pivotably mounting the mirror 3. In this embodiment, the arm 182 functions to support the mirror 3 and also functions as a handle for the lighting device.

In FIG. 76, a plate 18'' is disposed inside of the cylindrical body 5, and the cylindrical body 5 has holes 19' through which screw elements 18' extend to the outside of the body 5. Fastening elements such as the nuts 20' are threaded to the screws 18' to thereby secure the arm 182' onto the cylindrical body 5.

It will be noted that the arm 182' not only supports the mirror 3 but also functions as a handle to hold the lamp. Also, the arm 182' is located outside of the body 5 such that the arm 182' does not become heated, thereby enabling it to be readily grasped by a person desiring to move the lamp.

Lamps according to FIG. 1 and according to FIG. 76 were placed in a room which was at 25° C. room temperature. The temperatures of the handles were measured and the temperature of the handle in the embodiment of FIG. 76 was 30° C., while the temperature of the handle in the FIG. 1 embodiment was 62° C. Underwriters Laboratories (UL) specifies that the temperature of a handle should be less than 50° C. Thus, the lamp of FIG. 76 meets this criterion.

In the embodiment of FIG. 76, the arm 182' is bent only one time, while in the embodiment of FIG. 1, it is bent at three different places. Thus, the embodiment of FIG. 76 has the advantage that it can be produced at a lower cost, the arm has a dual function, that is, it functions as a support for the mirror and as a handle to move the lamp, and in addition, the handle is maintained at a suitable lower temperature so that it can be grasped by a person's hand without being overheated.

When the embodiments of the invention employing a floor stand are provided, it is apparent that the advantage is achieved that the lighting device requires less space than a conventional lamp, for example, when the lamp is positioned at a room corner, since a large shade of the type employed with conventional lamps is not required. In addition, when a floor stand is employed, it is possible for a person to see his or her face on the mirror. The base of the floor stand 103 is smaller in size and requires less space than a conventional stand.

The device of the invention enables a simple construction, and it is less expensive to produce since no shade is required. It can easily be employed as a mirror, lamp, etc., and the telescoping arrangements in accordance with the invention render the height of the lamp to be easily changed. Still further, the lighting device of the invention does not have the disadvantage of dazzling, i.e., the direct viewing of the light bulb, when the pole mounted lighting device of the invention is directed downwardly to a person sitting, for example, in a chair.

Since the lamp of the invention need not be positioned overhead, as in the case of a conventional lighting device, the user of the lighting device is not subjected to the flow of heat. This enables the person to more easily concentrate on reading or the like. The heat of the light source is fully radiated, and the life of the lamp is prolonged with lesser electric consumption. The lighting device in accordance with the invention is hence extremely versatile in application.

While the invention has been disclosed with reference to a number of embodiments, it is apparent that variations and modifications may be made therein, and it is therefore intended in the following claims to cover each such variation and modification as falls within true spirit and scope of the invention.

What is claimed is:

1. A lighting device comprising a hollow body, a light source means mounted within said hollow body, a U-shaped supporting arm having first and second spaced leg portions and a U-shaped portion integrally interconnecting said first and second spaced leg portions such that said first and second spaced leg portions are arranged in generally parallel spaced relation to each other with said second leg portion extending upwardly, securing means securing said first leg portion to said hollow body, a reflecting means, and mounting means mounting said reflecting means on said second leg portion at a location above and spaced from said hollow body, said second leg portion functioning to support said reflecting means at said location above and spaced from said hollow body and also functioning as a handle for the lighting device, said second leg portion thus being located outside and spaced from said hollow body to prevent heating of said second leg portion by said light source means during use thereof.

2. A lighting device according to claim 1, wherein said securing means comprises a plate member having threaded members extending therefrom and passing through said hollow body and said first leg portion, said plate means being disposed within said hollow body and said first leg portion being disposed outside of said hollow body.

3. A lighting device comprising a hollow body having a cylindrical portion and a closure portion, said cylindrical portion having a longitudinal vertical axis, one longitudinal end of said cylindrical portion being open, said closure portion having a closed end, an open end joined to the other end of said cylindrical portion, and a surface inclined radially inwardly from said open end to said closed end of said closure portion, a light source means mounted within said body longitudinally inwardly of said open end of said cylindrical portion including a light source located above the inclined surface of said closure portion, mounting means mounted on said body and extending externally of said body, reflecting means movably mounted on said mounting means in a position spaced from said open end of said cylindrical portion and generally aligned with said longitudinal axis of said cylindrical portion such that the light radiated from said light source means passes to said reflecting means to be reflected by said reflecting means, ventilation means in said inclined surface of said closure portion for admitting a flow of ambient air into said body below said light source, said light source means heating the air admitted into said body such that said heated air flows generally longitudinally in said body to exit upwardly from said open end of said cylindrical portion as further ambient air is drawn into said body below said light source through said ventilation means, whereby the lighting device is cooled by said flow of air upwardly through said body, said ventilation means comprising a plurality of spaced openings in said inclined surface of said closure portion, said body and said ventilation means being constructed and arranged to provide a chimney effect for air flow from said ventilation means to said open end of said cylindrical portion of said body when heated by said light source means, and a stand on which said body is mounted, said stand comprising an elongated upright pole having a bottom support, a receiving plate on the upper end of said upright pole, said receiving plate having a cylindrical rim portion defining a recess on top of said receiving plate, and a base mounted to said closed end of said tapered portion, said base being received in said recess to thereby mount the lighting device on said upright pole.

4. A lighting device according to claim 3 further comprising means in said base defining an opening, and pin means on said receiving plate, said pin means being disposed in said opening.

5. A lighting device comprising a hollow body having a cylindrical portion and a closure portion, said cylindrical portion having a longitudinal axis, one longitudinal end of said cylindrical portion being open, said closure portion having a closed end and an open end joined to the other end of said cylindrical portion, a light source means mounted within said body longitudinally inwardly of said open end of said cylindrical portion, mounting means mounted on said body and extending externally of said body, reflecting means movably mounted on said mounting means in a position spaced from said open end of said cylindrical portion and generally aligned with said longitudinal axis of said cylindrical portion such that the light radiated from said light source means passes to said reflecting means to be reflected by said reflecting means, ventilation means in said closure portion for admitting a flow of ambient air into said body, said light source means heating the air admitted into said body such that said heated air flows generally longitudinally in said body to exit from said open end of said cylindrical portion as further ambient air is drawn into said body through said ventilation means, whereby the lighting device is cooled by said flow of air through said body, a photo slide means, and pivotal means pivotably mounting said photo slide means on said mounting means for pivotable movement between a plurality of positions, said photo slide means when in one of said pivotal positions overlying said open end of said cylindrical portion of said body and being generally aligned with said longitudinal axis, said photo slide means when in another of said pivotal positions being disposed outside of an imaginary cylinder which extends longitudinally as a continuation of said cylindrical portion of said body.

6. A lighting device according to claim 5, wherein said photo slide means when in said one pivotal position is disposed between said open end of said cylindrical portion of said body and said reflecting means such that light from said light source means passes through said photo slide means and then passes to said reflecting means for reflection on a screen.

7. A lighting device according to claim 6 further comprising a lens means mounted on said cylindrical portion of said body, said lens means being disposed in a position such that the light reflected by the reflecting means passes through said lens means before reaching said screen.

8. A lighting device according to claim 7, wherein said lens means is mounted on said cylindrical portion of said body at a position diametrically opposite to said fastening means.

* * * * *